US009027729B2

(12) United States Patent
Furuichi

(10) Patent No.: US 9,027,729 B2
(45) Date of Patent: May 12, 2015

(54) BANKNOTE HANDLING DEVICE AND PASSING UNIT USED THEREIN

(75) Inventor: Masaki Furuichi, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 13/990,789

(22) PCT Filed: Dec. 6, 2011

(86) PCT No.: PCT/JP2011/078192

§ 371 (c)(1),
(2), (4) Date: May 30, 2013

(87) PCT Pub. No.: WO2012/132121

PCT Pub. Date: Oct. 4, 2012

(65) Prior Publication Data

US 2013/0247799 A1 Sep. 26, 2013

(30) Foreign Application Priority Data

Mar. 29, 2011 (JP) ..... 2011-073081

(51) Int. Cl.
*G07F 7/04* (2006.01)
*G07D 9/00* (2006.01)
*G07D 11/00* (2006.01)

(52) U.S. Cl.
CPC ..... *G07D 9/00* (2013.01); *G07D 11/0039* (2013.01); *G07D 11/0027* (2013.01); *G07D 11/0078* (2013.01); *G07D 11/0084* (2013.01); *G07D 11/0036* (2013.01); *G07D 11/0081* (2013.01)

(58) Field of Classification Search
USPC ..... 194/206, 207; 209/534; 382/135; 235/379
See application file for complete search history.

(56) References Cited

U.S. PATENT DOCUMENTS

| | | | | |
|---|---|---|---|---|
| 6,142,284 | A * | 11/2000 | Saltsov | 194/207 |
| 2004/0204081 | A1* | 10/2004 | Kim | 455/557 |
| 2007/0278064 | A1* | 12/2007 | Hallowell et al. | 194/206 |
| 2008/0290595 | A1 | 11/2008 | Fujita et al. | |
| 2010/0206689 | A1* | 8/2010 | Oba et al. | 194/206 |
| 2013/0161385 | A1* | 6/2013 | Graef et al. | 235/379 |

FOREIGN PATENT DOCUMENTS

| | | |
|---|---|---|
| CN | 101311972 | 11/2008 |
| EP | 1 995 698 A2 | 11/2008 |
| EP | 2 096 062 A2 | 9/2009 |
| GB | 2 046 975 A | 11/1980 |

(Continued)

OTHER PUBLICATIONS

Chinese Office Action with Its English-language Translation, issued on Nov. 14, 2014, in connection with the corresponding Chinese patent application No. 201180057214.7.

*Primary Examiner* — Jeffrey Shapiro
(74) *Attorney, Agent, or Firm* — Rabin & Berdo, P.C.

(57) ABSTRACT

A banknote handling device includes a safe that protects banknotes (casing of a second unit), a first conveyance path externally provided to the safe, and a second conveyance path internally provided to the safe. The safe is provided with at least one opening portion through which the banknotes pass. A passing unit including a passing conveyance mechanism that passes a banknote between the first conveyance path and the second conveyance path and a left-behind sensor that detects a banknote that is left-behind, is detachably installed inside the opening portion of the safe.

19 Claims, 8 Drawing Sheets

(56) References Cited

FOREIGN PATENT DOCUMENTS

| | | | |
|---|---|---|---|
| JP | 2000-172946 | A | 6/2000 |
| JP | 2001-236546 | | 8/2001 |
| JP | 2002-163704 | A | 6/2002 |
| JP | 2002-260057 | A | 9/2002 |
| JP | 2005-208954 | A | 8/2005 |
| JP | 2008-293285 | A | 12/2008 |
| JP | 2009-205252 | A | 9/2009 |
| JP | 2010-039831 | A | 2/2010 |
| JP | 2010-231280 | | 10/2010 |

* cited by examiner

BANKNOTE HANDLING DEVICE AND PASSING UNIT USED THEREIN

TECHNICAL FIELD

The present invention relates to a banknote handling device that handles banknotes and a passing unit used in the banknote handling device.

BACKGROUND ART

Banknote handling devices include, for example, Automated Teller Machines (ATMs), cash dispensers, service window devices, or money changing machines that are mainly used in financial institutions, and cash registers that is mainly used in the retail industry.

In general, a banknote handling device is provided with plural units inside a casing (see Japanese Patent Application Laid-Open (JP-A) No. 2000-172946). The plural units include, for example, a unit for classifying and sorting banknotes (referred to below as the "first unit") and a unit in which banknotes are kept stored (referred to below as the "second unit").

The first unit includes a banknote input/output section that takes banknotes P into the device and discharges banknotes P out of the device, a classification section that classifies banknotes, a conveyance path on which banknotes are conveyed (referred to below as the "first conveyance path"), and a conveyance mechanism (referred to below as the "first conveyance mechanism") that conveys banknotes along the first conveyance path.

The second unit includes one or more cassettes in which banknotes are housed, a conveyance path on which banknotes are conveyed (referred to below as the "second conveyance path"), and a conveyance mechanism (referred to below as the "second conveyance mechanism") that conveys banknotes along the second conveyance path.

Further, the second unit is provided with a casing that covers the periphery of the cassettes, the second conveyance path and the second conveyance mechanism. The casing of the second unit functions as a safe that protects the banknotes housed inside the cassettes by covering the periphery of the cassettes.

The casing of the second unit must be built robust in order to protect the banknotes that are housed inside the cassettes. Therefore, the casing of the second unit is configured from a high strength material such as metal or concrete. Further, the thickness of a plate member of the casing of the second unit is designed so as to have a predetermined value or greater. Although the thickness of the plate member is not stipulated per se in Japan, outside of Japan multiple grades of thickness are stipulated in increments of, for example, several tens of mm, such as 40 mm or 80 mm, corresponding to various regional or national standards.

One or more opening portions are provided in the casing of the second unit, between the first conveyance path of the first unit and the second conveyance path of the second unit. The opening portions function as conveyance paths connecting the first conveyance path of the first unit and the second conveyance path of the second unit. The depth direction length of the opening portion (i.e., the distance between the first conveyance path and the second conveyance path) is the same as the thickness of the plate member of the casing (safe) of the second unit and varies depending on the thickness of the plate member of the casing.

In such a configuration, the banknote handling device passes banknotes between the first unit and the second unit during use. However, in the banknote handling device, if the thickness of the plate member of the casing of the second unit that acts as a safe is excessively thick, banknotes may stop inside the opening portion. For example, in a case in which some kind of a banknote conveyance error occurs in the banknote handling device, the first conveyance mechanism of the first unit and the second conveyance mechanism of the second unit may stop. At this time, if a banknote is travelling through the opening portion, the banknote may stop inside the opening portion in the banknote handling device. The thicker the thickness of the plate member of the casing of the second unit, the greater the likelihood is of such a state occurring. If banknote has stopped inside the opening portion in the banknote handling device and the first unit or the second unit is pulled out from the casing of the banknote handling device in this state, there is the possibility that the banknote is damaged.

Therefore, in the banknote handling device, if the thickness of the plate member of the casing of the second unit that acts as a safe is excessively thick (that is, at least thick enough that there is a possibility that a banknote may stop inside the opening portion), a conveyance mechanism (referred to below as a "passing conveyance mechanism") for passing a banknote between the first conveyance path of the first unit and the second conveyance path of the second unit, a sensor that detects for a left-behind banknote (referred to below as a "left-behind sensor") and the like are additionally installed inside the opening portion during manufacture.

Due to the additional installation of the passing conveyance mechanism and the left-behind sensor inside the opening portion, the banknote handling device conveys banknotes towards the downstream side by the passing conveyance mechanism while monitoring for the presence of banknotes left-behind in the opening portion by the left-behind sensor. Banknotes can be thereby conveyed in the banknote handling device without letting banknotes inside the opening portion.

SUMMARY OF INVENTION

Technical Problem

However, in conventional banknote handling devices, due to the thickness of the plate members of safes (the casing of the second unit) varying according to various regional or national standards, it requires effort to install a passing conveyance mechanism and a left-behind sensor to the opening portion of a safe corresponding to each safe having different thicknesses of plate member.

For example, in a banknote handling device manufacturing facility, banknote handling devices destined for various countries and regions are manufactured while being mixed and conveyed on the same manufacturing line. Thus, an installation operator of a passing conveyance mechanism and left-behind sensor needs to prepare in advance passing conveyance mechanisms and left-behind sensors corresponding to each safe, and install them to the opening portions of each safe without mistakenly using members intended for another safe. The greater the number of components handled, the easier it becomes to confuse members. Therefore, the installation operator must carefully manufacture the banknote handling devices without confusing the members. Moreover, the installation position of the left-behind sensor differs in each safe since the thickness of the plate member differs in each safe. Therefore, in conventional banknote handling devices, it requires effort to install a passing conveyance mechanism and a left-behind sensor to the opening portion of the safe corresponding to each safe having different thicknesses of plate members.

In order to address the above issues, the present invention provides a banknote handling device that reduces the effort involved in installing a passing conveyance mechanism and a left-behind sensor to an opening portion of a safe corresponding to each of the safes having different thicknesses of plate member, and provides a passing unit used in the banknote handling device.

Solution to Problem

A first aspect of the present invention is a banknote handling device that handles banknotes, including: a safe that protects banknotes; a first conveyance path provided externally to the safe; and a second conveyance path provided internally to the safe, the safe including: at least one opening portion through which the banknotes pass; and a passing unit that is detachably installed inside the opening portion, and that includes a passing conveyance mechanism that passes a banknote between a first conveyance path and a second conveyance path, and a left-behind sensor that detects a banknote that is left behind.

In the present aspect, the passing conveyance mechanism and the left-behind sensor are integrally configured as the passing unit. The passing conveyance mechanism and the left-behind sensor can be installed inside the opening portion of the safe of the banknote handling device simply by installing the passing unit inside the opening portion of the safe. Moreover, since the banknote handling device has a reduced number of components, confusion between members can be prevented. Therefore, the banknote handling device can reduce the effort involved in installing the passing conveyance mechanism and the left-behind sensor in the opening portion of the safe corresponding to each of the safes having different thicknesses of plate member. The depth direction length (the distance between the first conveyance path and the second conveyance path) of the opening portion is the same as the thickness of the plate member of the safe. Passing units that are installed to the opening portions preferably have dimensions that correspond to the opening portion of each safe.

The present aspect may further include a device-side connector that connects to a sensor-side connector of the left-behind sensor of the passing unit; a connector connection detector that detects connection of the sensor-side connector to the device-side connector; a first conveyance mechanism that conveys a banknote along the first conveyance path; a second conveyance mechanism that conveys a banknote along the second conveyance path; and a conveyance controller that controls operation of the first conveyance mechanism, the second conveyance mechanism and the passing conveyance mechanism of the passing unit, and that, if the connector connection detector has detected connection of the sensor-side connector to the device-side connector, determines a current state of the banknote handling device to be an installed state of the passing unit, and performs operation control for a passing unit installed state on the first conveyance mechanism, the second conveyance mechanism, and the passing conveyance mechanism of the passing unit.

The present aspect may further include a storage section that, prior to operation commencement, stores casing thickness data expressing a thickness of a plate member of the safe and operation parameter data stipulating detection durations for detection of a conveyance error of the banknotes inside the passing unit, wherein the conveyance controller: identifies the detection duration associated with the casing thickness data based on the operation parameter data if the conveyance controller has determined the current state of the banknote handling device to be the passing unit installed state, prior to operation commencement; and uses the identified detection duration to monitor for occurrence of conveyance errors of the banknotes inside the passing unit during operation.

The present aspect may further include a conveyance duration measurement section that measures a conveyance duration of a banknote passing through the opening portion of the safe between two predetermined locations; and a conveyance duration comparison section that compares the conveyance duration of the banknote measured by the conveyance duration measurement section against a predetermined threshold value duration, wherein if comparison by the conveyance duration comparison section shows that the conveyance duration of the banknote is equal to or greater than the threshold value duration, even if the connector connection detector has not detected connection of the sensor-side connector to the device-side connector, the conveyance controller determines the current state of the banknote handling device to be the passing Unit installed state and performs operation control for the passing unit installed state on the first conveyance mechanism, the second conveyance mechanism, and the passing conveyance mechanism of the passing unit.

In the present aspect the conveyance controller may convey plural banknotes with the first conveyance mechanism and the second conveyance mechanism; the conveyance duration measurement section may measure conveyance durations of the plural banknotes passing through the opening portion of the safe; and the conveyance duration comparison section may compare an average value of the conveyance durations of the plural banknotes measured by the conveyance duration measurement section against the threshold value duration.

In the present aspect the conveyance controller may perform operation control on the first conveyance mechanism, the second conveyance mechanism, and the passing conveyance mechanism of the passing unit such that a conveyance speed of the banknotes passing through the opening portion of the safe is slower than a conveyance speed at other sections.

The present aspect may further include a notification section that notifies a maintenance operator of the banknote handling device in a case in which an installation registration of the passing unit to the banknote handling device has been omitted, or in a case in which a connection operation of the sensor-side connector to the device-side connector has been omitted.

The present aspect may further include a drive mechanism provided at a periphery of the opening portion of the safe, the drive mechanism engaging with the passing conveyance mechanism of the passing unit to supply drive force to the passing conveyance mechanism.

A second aspect of the present invention is a passing unit that is installed inside an opening portion provided at a safe inside a banknote handling device, the banknote handling device including a first conveyance path that is a conveyance path provided externally to the safe and a second conveyance path that is a conveyance path provided internally to the safe, and the passing unit including; a passing conveyance path that passes a banknote between the first conveyance path and the second conveyance path; a passing conveyance mechanism that conveys the banknote along the passing conveyance path; a left-behind sensor that detects a banknote left behind in the passing conveyance path; and a casing that internally accommodates the passing conveyance path, the passing conveyance mechanism and the left-behind sensor, and that is formed with dimensions that are detachable with respect to the opening portion of the banknote handling device.

The passing unit is integrally configured with the passing conveyance mechanism and the left-behind sensor, and may be used in the banknote handling device according to the first aspect. The passing unit preferably has dimensions corresponding to the opening portion of each safe.

In the second aspect, the passing conveyance mechanism may engage with a drive mechanism provided in the banknote handling device to obtain drive force and convey the banknote.

In the second aspect, the left-behind sensor may include a sensor-side connector that includes: a first line that outputs a detection signal of the banknote from the left-behind sensor to a left-behind banknote detector that is provided at the banknote handling device and that detects a banknote left behind in the passing conveyance path; and a second line in which a connection detection current flows to a connector connection detector, which is provided at the banknote handling device and that detects connection of the sensor-side connector to a device-side connector provided at the banknote handling device, if the sensor-side connector is connected to the device-side connector.

Effect of Invention

According to the first aspect, it is possible to provide a banknote handling device capable of reducing the effort involved in installing a passing conveyance mechanism and a left-behind sensor to an opening portion of a safe, corresponding to each safe having different thicknesses of plate member.

According to the second aspect, a passing unit used in the banknote handling device according to the first aspect can be provided.

DESCRIPTION OF EMBODIMENTS

Figure 1:
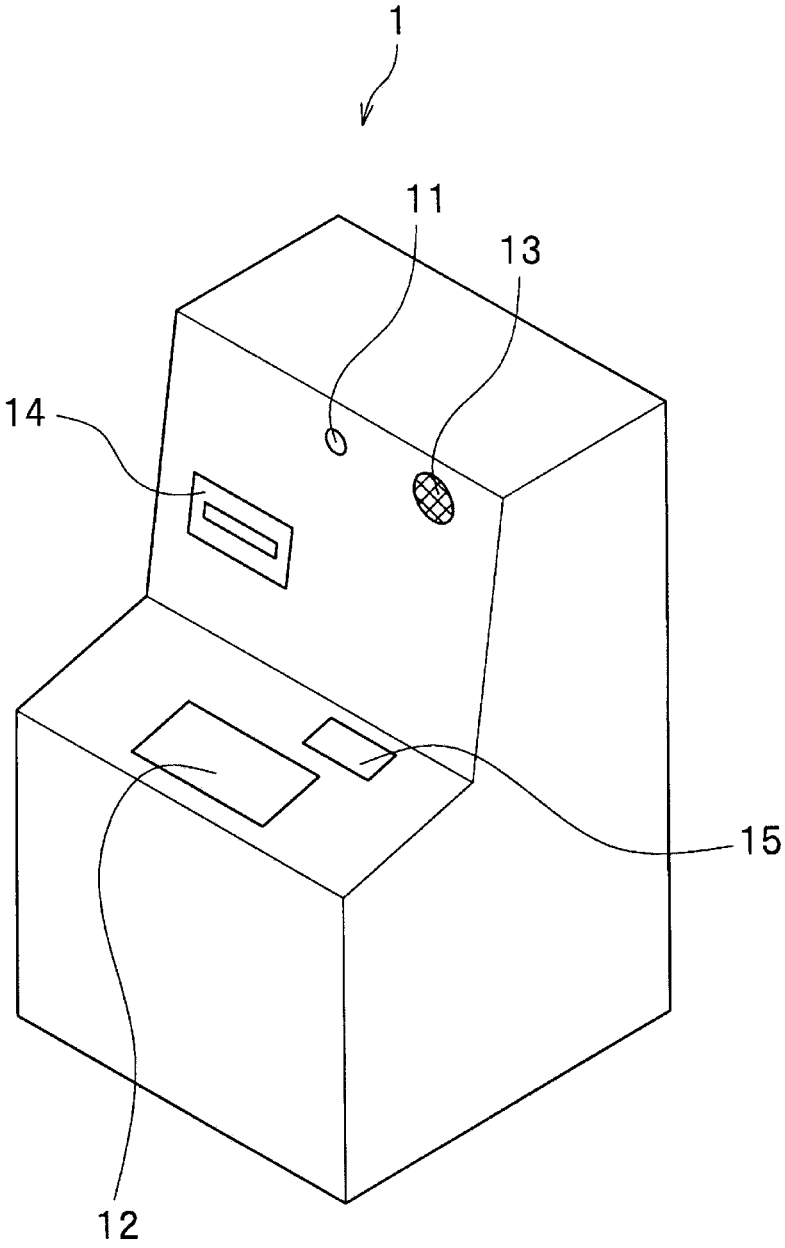
FIG. 1 is a perspective view illustrating an external view of a banknote handling device according to a first exemplary embodiment.

Detailed explanation follows regarding an exemplary embodiment of the present invention (referred to below as the "present exemplary embodiment"), with reference to the drawings. Note that the drawings are merely schematic drawings providing illustration such that the present invention can be adequately understood. Accordingly, embodiments are not limited to the examples illustrated in the drawings. Moreover, common components and similar components are allocated the same reference numerals in the drawings, and duplicate explanations thereof are omitted.

First Exemplary Embodiment

A banknote handling device according to the present first exemplary embodiment is intended to address the above issue encountered in conventional banknote handling devices that "it requires effort to install a passing conveyance mechanism and a left-behind sensor to the opening portion of a safe corresponding to each safe having different thicknesses of plate member" A banknote handling device of the first exemplary embodiment is configured such that a passing conveyance mechanism and a left-behind sensor are installed inside an opening portion of a safe by simply installing a passing unit inside the opening portion of the safe.

The banknote handling device according to the first exemplary embodiment does not only address the above issue encountered in conventional banknote handling devices, but is also intended to address the following Additional Issue 1 to Additional Issue 3, as explained in the section "Features of the Banknote Handling Device".

Additional Issue 1

In a conventional banknote handling device, an installation operator is required to perform an "installation registration of passing conveyance mechanism", described later.

In a banknote handling device, the conveyance distance between a first conveyance mechanism and a second conveyance mechanism varies depending on whether or not a passing conveyance mechanism is installed. Therefore, in a banknote handling device there is a need to vary control of the first conveyance mechanism and the second conveyance mechanism depending on whether or not a passing conveyance mechanism is installed.

Conventional banknote handling devices do not include a detection mechanism that automatically detects the installation of a passing conveyance mechanism. Therefore, when the passing conveyance mechanism has been installed to the opening portion of the safe, the installation operator is required to perform an operation (referred to below as a "installation registration of passing conveyance mechanism") to register the banknote handling device data indicating that a passing conveyance mechanism has been installed (referred to below as "passing conveyance mechanism installation data"). Accordingly, in the conventional banknote handling device the installation operator is required to perform the installation registration of passing conveyance mechanism.

Additional Issue 2

In the conventional banknote handling device, banknote conveyance errors may occur in a case in which the "installation registration of passing conveyance mechanism" has been omitted.

For example, an installation operator may forget to perform the installation registration of passing conveyance mechanism after installing the passing conveyance mechanism to the opening portion of the safe. Accordingly, in the related banknote handling device, there is a case in which the installation registration of passing conveyance mechanism has been omitted.

If the installation registration of passing conveyance mechanism were omitted in the related banknote handling device, the control of the first conveyance mechanism and the second conveyance mechanism would not be changed even though the conveyance distance of the first conveyance mechanism and the second conveyance mechanism had changed due to the installation of the passing conveyance mechanism. Therefore, in such cases, banknote conveyance errors (for example jams, errors of non-arrival within a specific duration for a specific conveyance interval (stretch), and the storage of banknotes in cassettes of a different denomination) may have been occurred in the conventional banknote handling device.

If such banknote conveyance errors occur, the conventional banknote handling device goes into a suspension state. In this case, a maintenance operator is required to attend the location, investigate the cause of the conveyance error, and resolve the cause of the conveyance error. Therefore in such cases, in the related banknote handling device the burden of investigating and resolving the cause of the conveyance error is forced on the maintenance operator, and the suspension state persists for a comparatively long period of time, which lowers the operational efficiency.

Additional Issue 3

When assuming a configuration in which a detection mechanism for automatically detecting the installation of a passing conveyance mechanism is added to the related banknote handling device, there is the possibility of banknote conveyance errors occurring in the banknote handling device of the assumed configuration if an "attachment of the detection mechanism" is omitted.

For example, a configuration may be assumed wherein a detection mechanism that automatically detects the installation of the passing conveyance mechanism is added to the conventional banknote handling device. However, if an attachment of detection mechanism (for example, a connection of a connector of the detection mechanism) is omitted in the banknote handling device of the assumed configuration, similarly to in Additional Issue 2 described above, the control of the first conveyance mechanism and the second conveyance mechanism would not be changed even though the conveyance distance of the first conveyance mechanism and the second conveyance mechanism had changed due to the installation of the passing conveyance mechanism. Therefore, it is supposed that banknote conveyance errors could occur in the banknote handling device of the assumed configuration.

In a case in which a banknote conveyance error occurs, a maintenance operator is required to attend the location, investigate the cause of the conveyance error, and resolve the cause of the conveyance error. Accordingly, in such cases, in the banknote handling device of the assumed configuration, the burden of investigating and resolving the cause of the conveyance error is forced on the maintenance operator, and it is supposed that the suspension state could persist for a comparatively long period of time, which lowers the operational efficiency.

Configuration of the Banknote Handling Device

Figure 2:
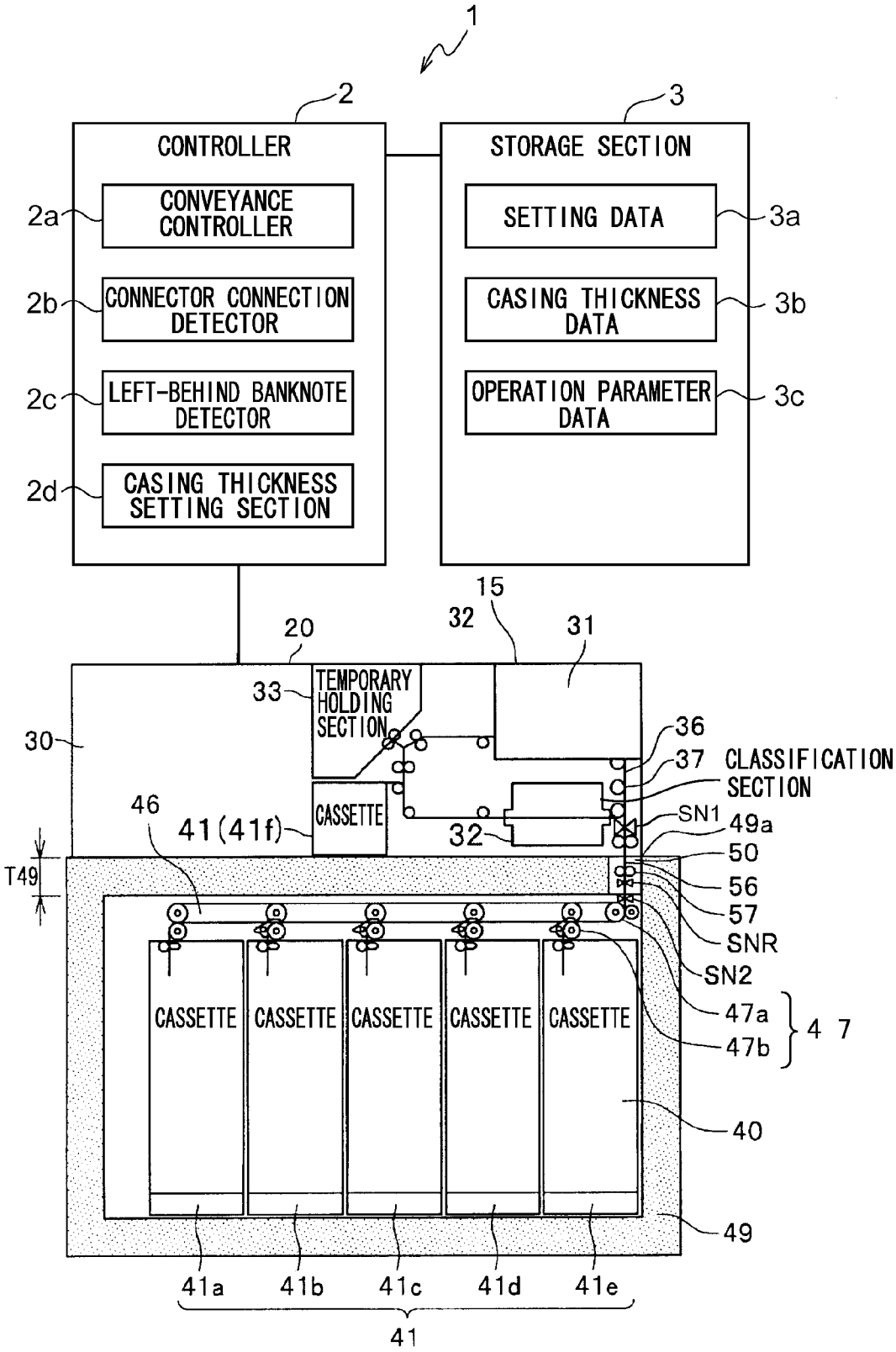
FIG. 2 is a diagram illustrating an internal configuration of the banknote handling device according to the first exemplary embodiment.

The configuration of the banknote handling device according to the first exemplary embodiment will be described below with reference to FIG. 1 and FIG. 2. FIG. 1 and FIG. 2 each illustrate a configuration of the banknote handling device according to the first exemplary embodiment. FIG. 1 is an external view of a banknote handling device 1 according to the first exemplary embodiment. FIG. 2 illustrates an internal configuration of the banknote handling device 1.

Examples of the banknote handling device 1 include Automated Teller Machines (ATMs), cash dispensers, service window devices, and money changing machines mainly used in financial institutions, and cash registers mainly used in the retail industry and the like. In the present embodiment, the banknote handling device 1 is configured as an Automated Teller Machine, and explanation is given supposing use in a financial institution. The banknote handling device 1 is hereinafter referred to as the ATM 1.

As illustrated in FIG. 1, the ATM 1 includes on the surface of a casing, a camera 11, a display/operation section 12, a speaker 13, a card insertion port 14, and a banknote input/output port 15.

The camera 11 is a component that captures images of user of the ATM 1.

The display/operation section 12 is a component that displays various information, and receives operations from a user. In the following explanation, the display/operation section 12 is configured by a touch panel. However, the display/operation section 12 may be a combination of a display section such as a display device and an input section such as a ten key.

The speaker 13 is a component that emits sound such as operation tones, warning tones, or spoken announcements.

The card insertion port 14 is a location into which a card belonging to a customer, such as a cash card or a money transfer card, is inserted.

The banknote input/output 15 is a location at which banknotes P (see FIG. 3B) are input or discharged.

Moreover, as illustrated in FIG. 2, inside the casing, the ATM 1 includes a controller 2, a storage section 3, and a banknote unit 20.

The controller 2 is a functional unit that controls the operation of the ATM 1. The controller 2 includes a conveyance controller 2*a*, a connector connection detector 2*b*, a left-behind banknote detector 2*c*, and a casing thickness setting section 2*d*.

The conveyance controller 2*a* is a functional unit that controls operation of each component relating to conveyance, classification, and storage operations with respect to the banknotes P (specifically, a banknote input/output section 31, a classification section 32, a temporary holding section 33, conveyance mechanisms 37, 47, 57, and cassettes 41, which are described later). Detection signals from various sensors SN (for example, conveyance sensors SN1, SN2 illustrated in FIG. 2, device upper portion sensors SNU and device lower portion sensors SNL, illustrated in FIG. 4) are input to the conveyance controller 2*a*. The conveyance controller 2*a* drives motors of each portion (for example, a passing unit motor MO50, a device upper portion motor MOU, and a device lower portion motor MOL, illustrated in FIG. 4) based on the input detection signals.

The connector connection detector 2*b* is a functional unit that detects connection of a sensor-side connector CNa of a left-behind sensor SNR (see FIG. 4 and FIG. 5) and a device-side connector CNb (see FIG. 4 and FIG. 5), which are described later.

The left-behind banknote detector 2*c* is a functional unit that detects a banknote P left-behind inside a conveyance path 56 of a passing unit 50, which are described later.

The casing thickness setting section 2*d* is a functional unit for setting data expressing a thickness T49 of a plate member of a casing 49 of a second unit 40, which are described later.

The storage section 3 is a storage unit that stores various data and programs. For example, the storage section 3 stores data such as setting data 3*a*, casing thickness data 3*b*, and operation parameter data 3*c*.

The setting data 3*a* is data expressing various settings relating to the operation of the ATM 1. The setting data 3*a* includes, for example, data expressing an installed state of the passing unit 50 (referred to below as "passing unit installation data"), and data expressing a connected state of the sensor-side connector CNa of the left-behind sensor SNR (see FIG. 4 and FIG. 5) and the device-side connector CNb (see FIG. 4 and FIG. 5) (referred to below as "connector connection data"), which are described later.

The casing thickness data 3*b* is data expressing the thickness T49 of a plate member of the casing 49 of the second unit 40, which are described later. The casing thickness data 3*b* may be, for example, numeric value data indicating a particular thickness in units such as "mm", or may be, for example, conversion data for converting pulse counts into numerical thickness values in cases in which a conveyance distance of the banknotes P is counted with a pulse count. The casing thickness data 3*b* is determined during design of the second unit 40.

The operation parameter data 3*c* is data that defines the operation of the conveyance mechanisms 37, 47, 57, which are described later. In the first exemplary embodiment, the operation parameter data 3*c* includes data defining a duration (referred to below as "detection duration") that serves as a threshold value for the detection of the occurrence of a banknote P conveyance error (for example, a jam or an error of non-arrival within a specific duration for a specific conveyance interval). "Detection duration" will be described in detail in the section
"Operation of the Banknote Handling Device".

The banknote unit 20 is a unit that classifies, sorts and stores the banknotes P. The banknote unit 20 is configured from plural units. Following description is given for a case in which the banknote unit 20 is configured by a first unit 30 that classifies and sorts the banknotes P, and the second unit 40 that stores the banknotes P. Moreover, description is given for a case in which the first unit 30 and the second unit 40 are stacked inside the ATM 1, as an upper unit and a lower unit, respectively.

The first unit 30 includes therein the banknote input/output section 31, the classification section 32, the temporary holding section 33, a conveyance path 36, the conveyance mechanism 37, and the cassettes 41.

The banknote input/output section 31 is a component that takes banknotes into the device and discharges banknotes to the outside of the device. The banknote input/output section 31 is disposed the inside of the banknote input/output port 15.

The classification section 32 is a component that classifies the banknotes P. The classification section 32 is provided on the conveyance path 36 of the first unit 30. The classification section 32 performs processing such as determining whether banknotes P being conveyed along the conveyance path 36 are genuine or counterfeit, determining banknote denominations, and counting the number of banknotes.

The temporary holding section 33 is a component that temporarily internally holds (houses) the banknotes P. For example, during pay-in operation, the temporary holding section 33 temporarily houses banknotes P that have been classified by the classification section 32 as genuine notes that are eligible for pay-in. The temporary holding section 33 is provided with a separation and stacking mechanism for this purpose. The banknotes P housed in the temporary holding section 33 are then separated and fed out onto the conveyance path 36 one by one by the separation and stacking mechanism, and are conveyed to specific locations by the conveyance mechanisms 37, 47, 57.

The conveyance path 36 is a path along which the banknotes P travel. The conveyance path 36 connects each of the components provided inside the first unit 30. In the following explanation, the conveyance path 36 will be referred to as the "first conveyance path 36" when distinguishing it from the other conveyance paths 46, 56.

The conveyance mechanism 37 is a component that conveys the banknotes P along the first conveyance path 36. In the following explanation, the conveyance mechanism 37 will be referred to as the "first conveyance mechanism 37" when distinguishing it from the other conveyance mechanisms 47, 57. In the present embodiment, the first conveyance mechanism 37 is described as being configured by conveyance rollers. However, the first conveyance mechanism 37 may be configured by a conveyance unit other than conveyance rollers (for example, by a conveyor belt).

The cassettes 41 are storage boxes that house banknotes P. In the example illustrated in FIG. 2, five cassettes 41 are provided in the second unit 40, and one cassette 41 is provided in the first unit 30. In the following explanation, when distinguishing the respective cassettes 41, the five cassettes 41 provided in the second unit 40 are referred to as "cassettes 41*a* to 41*e*", and the one cassette 41 provided in the first unit 30 is referred to as the "cassette 41*f*".

In the following, description is given for a case in which the cassettes 41*a* to 41*e* are respectively used as storage boxes for housing the banknotes P by denomination and the cassette 41*f* is used as a storage box for housing forgotten banknotes. However, the cassette 41*f* may be used for other purposes (for example, as a storage box for housing reject banknotes) depending on the application. Note that "forgotten banknotes" are banknotes P that a user has forgotten to collect. Moreover, "reject banknotes" are banknotes P that are classified as unsuitable for pay-out by the classification section 32 during pay-out operation.

The second unit 40 includes therein one or more of the cassettes 41 (the five cassettes 41*a* to 41*e* in the example illustrated in FIG. 2), the conveyance path 46, and the conveyance mechanism 47.

As described above, the cassettes 41 are storage boxes that house the banknotes P. In the example illustrated in FIG. 2, five cassettes 41*a* to 41*e* are disposed in a row in a horizontal direction as the cassettes 41. As described above, in the present embodiment, the cassettes 41*a* to 41*e* are respectively used as storage boxes for housing the banknotes P by denomination. However, the cassettes 41*a* to 41*e* may be used for other purposes depending on the application.

The conveyance path 46 is a path on which the banknotes P travel. The conveyance path 46 connects each of the components provided inside the second unit 40. In the following explanation, the conveyance path 46 will be referred to as the "second conveyance path 46" when distinguishing it from the other conveyance paths 36, 56.

The conveyance mechanism 47 is a component that conveys the banknotes P along the second conveyance path 46. In the following explanation, the conveyance mechanism 47 will be referred to as the "second conveyance mechanism 47" when distinguishing it from the other conveyance mechanisms 37, 57. In the following description, the second conveyance mechanism 47 is configured by conveyance rollers. However, the second conveyance mechanism 47 may be configured by a conveyance unit other than conveyance rollers (for example, by a conveyor belt).

In the example illustrated in FIG. 2, the second conveyance mechanism 47 includes conveyance sections 47*a* and separation/stacking sections 47*b*.

The conveyance sections 47*a* are components that convey the banknotes P along the second conveyance path 46.

The separation/stacking sections 47*b* are components that separate the banknotes P housed inside the cassettes 41 one by one and feed the banknotes P out of the cassettes 41 onto the conveyance path 46 during pay-out operation, and that convey the banknotes P from the conveyance path 46 into the cassettes 41 and stack the banknotes P inside the cassettes 41 during pay-in operation.

The second unit 40 includes the casing 49 that covers the periphery of the cassettes 41, the second conveyance path 46 and the second conveyance mechanism 47. The casing 49 functions as a safe that protects the banknotes P housed inside the cassettes 41 by covering the periphery of the cassettes 41.

The casing 49 must be robustly build in order to protect the banknotes P housed inside the cassettes 41. Therefore, the casing 49 is configured from a high strength material such as metal or concrete. Further, the casing 49 is designed so as to have the thickness T49 of a plate member equal to or greater than a specific value. Multiple grades of thickness are defined for the thickness T49 of the plate member, in increments of several tens of mm, such as 40 mm or 80 mm, corresponding to various regional or national standards.

The casing 49 is provided with one or more (one in the example illustrated in FIG. 2) opening portions 49*a* between the first conveyance mechanism 37 of the first unit 30 and the second conveyance mechanism 47 of the second unit 40. The opening portion 49*a* functions as a conveyance path connecting the first conveyance path 36 of the first unit 30 and the second conveyance path 46 of the second unit 40. The depth direction length of the opening portion 49*a* (i.e., the distance between the first conveyance path 36 and the second conveyance path 46) varies according to the thickness T49 of the plate member of the casing 49. However, the positional relationships between each of the components inside the second unit 40 do not vary depending on variations in the thickness T49 of the plate member of the casing 49.

The conveyance sensors SN1, SN2 are provided at the periphery of the opening portion 49*a*. The conveyance sensors SN1, SN2 are respectively sensors that detect the arrival position of a banknote P that is being conveyed. The conveyance sensors SN1, SN2 are respectively provided at both sides of the opening portion 49*a*. In the example illustrated in FIG. 2, the conveyance sensor SN1 is provided directly above the opening portion 49*a* at the first conveyance path 36 side. The conveyance sensor SN2 is provided directly below the opening portion 49*a* at the second conveyance path 46 side. The conveyance sensor SN1 is one type of the device upper portion sensors SND illustrated in FIG. 4, and the conveyance sensor SN2 is one type of the device lower portion sensors SNL illustrated in FIG. 4. In the following explanation, the conveyance sensor SN1 is referred to as the "first conveyance sensor SN1", and the conveyance sensor SN2 is referred to as the "second conveyance sensor SN2" when distinguishing the conveyance sensors SN1, SN2.

In the ATM 1 of such a configuration, the banknotes P are passed between the first unit 30 and the second unit 40 during operation. For example, during pay-in operation in the ATM 1, after banknotes P are input into the banknote input/output port 15, the banknotes P are classified by the classification section 32 inside the first unit 30, and banknotes P that have been classified as genuine notes are passed from the first unit 30 to the second unit 40, and housed in the cassette 41 of the corresponding denomination inside the second unit 40. During pay-out operation in the ATM 1, the banknotes P are fed out from the cassettes 41 inside the second unit 40, passed from the second unit 40 to the first unit 30, and classified by the classification section 32 inside the first unit 30. Banknotes P that have been classified as reusable notes are stacked in the banknote input/output section 31, and are discharged from the banknote input/output port 15.

During the above processing, the banknotes P travel through the opening portion 49*a*. However, in the ATM 1, if the thickness T49 of the plate member of the casing 49 of the second unit 40 serving as a safe is excessively thick, there is the possibility that a banknote P stops inside the opening portion 49*a*. For example, if an error occurs while conveying a banknote P in the ATM 1, the first conveyance mechanism 37 of the first unit 30 and the second conveyance mechanism 47 of the second unit 40 are stopped. If a banknote P is travelling through the opening portion 49*a* when this occurs, the banknote P may stop inside the opening portion 49*a* of the ATM 1. The greater the thickness T49 of the plate member of the casing 49, the higher the likelihood is of such a state occurring. In a case in which a banknote P has become stationary inside the opening portion 49*a*, if the first unit 30 or the second unit 40 is pulled out from the casing of the ATM 1 in this state, there is the possibility of the banknote P sustaining damage.

Therefore, if the thickness T49 of the plate member of the casing 49 is excessively thick (that is, if it is at least thick enough such that there is a possibility that a banknote P may stop inside the opening portion 49*a*, an additional unit 50 is installed inside the opening portion 49*a* during manufacture of the ATM 1, as illustrated in FIG. 2. The additional unit 50 is a unit that passes a banknote P between the first unit 30 and the second unit 40. Hereinafter, the additional unit 50 is referred to as the "passing unit 50".

Configuration of the Passing Unit

Figure 3A:
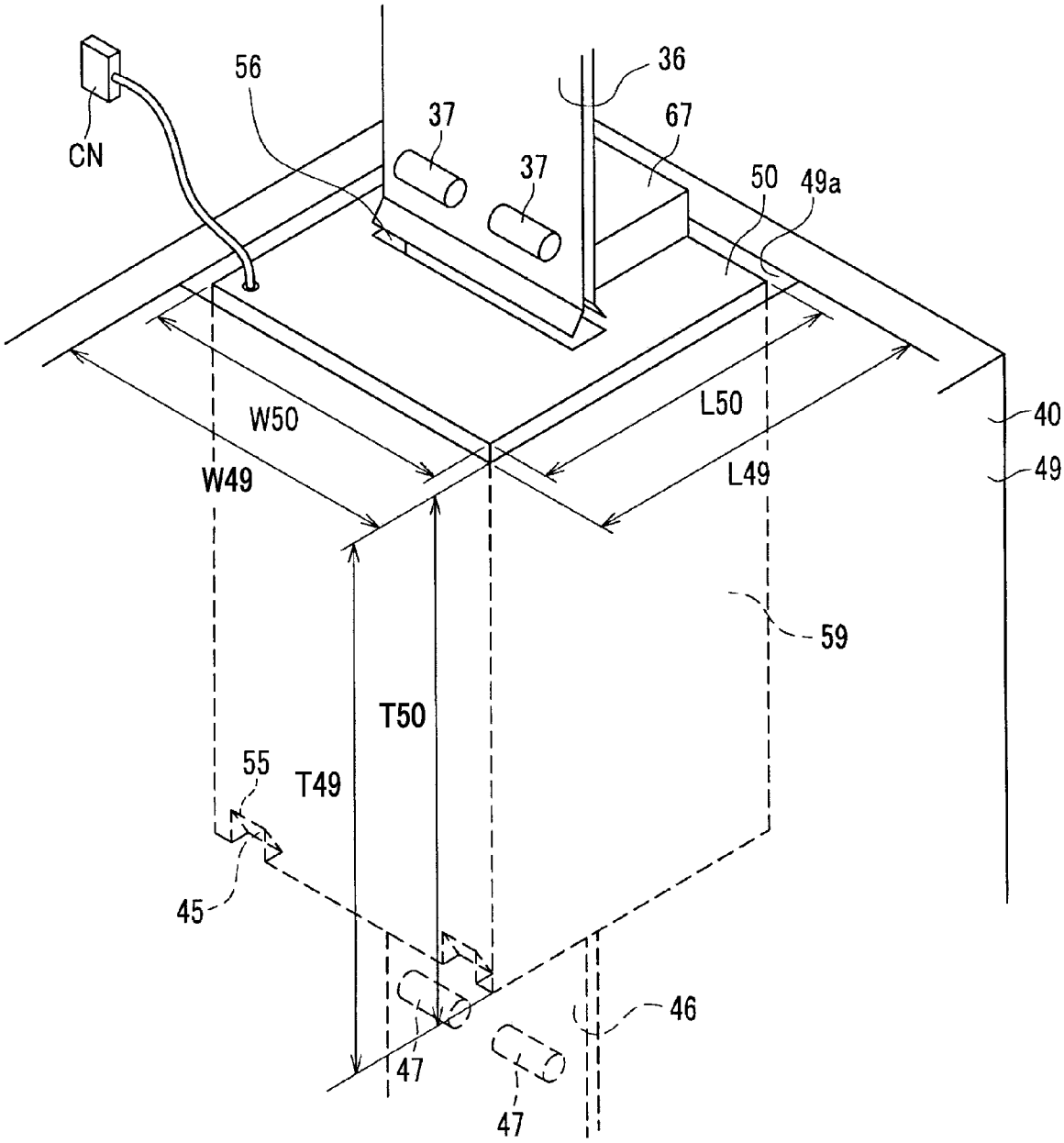
FIG. 3A is a diagram illustrating a configuration of a passing unit used in the first exemplary embodiment.
Figure 3B:
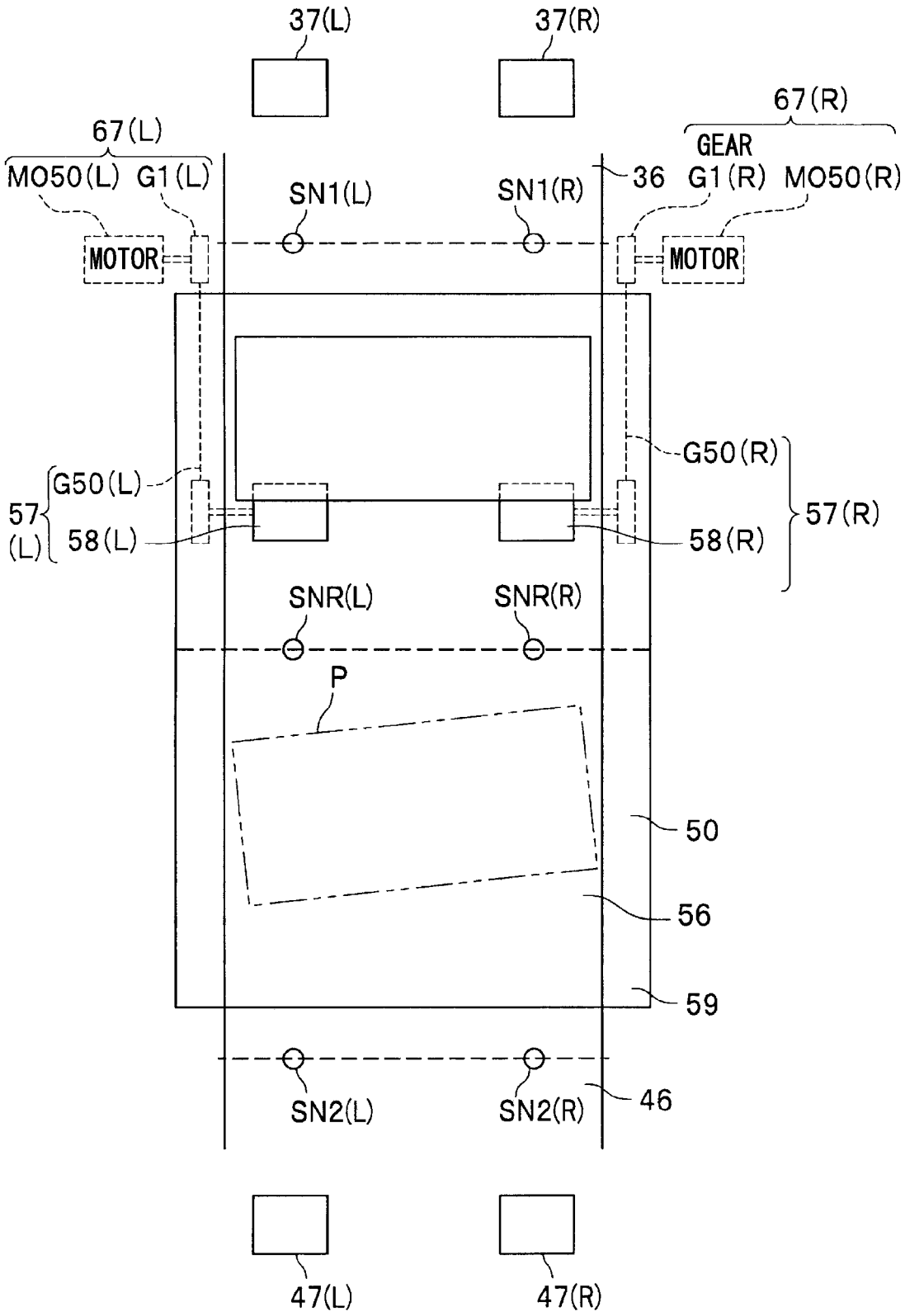
FIG. 3B is another diagram illustrating a configuration of the passing unit used in the first exemplary embodiment.

Explanation follows regarding the configuration of the passing unit 50 used in the first exemplary embodiment, with reference to FIG. 3A and FIG. 3B. FIG. 3A and FIG. 3B respectively illustrate the configuration of the passing unit 50 used in the first exemplary embodiment. FIG. 3A illustrates a state in which the passing unit 50 has been installed inside the opening portion 49*a*. FIG. 3B illustrates the configuration of the passing unit 50 with the casing 59 cut away along the conveyance path 56 (see FIG. 3A).

FIG. 3A illustrates an example in which casing 59 of the passing unit 50 is formed in a rectangular box shape. However, it is possible to configure the casing 59 in shapes other than a rectangular box shape (for example, a configuration of plural bar-shaped members fixed together by screws or the like) provided that it is a configuration in which the passing conveyance path 56, a passing conveyance mechanism 57 and the left-behind sensor SNR, which are described later, are fixed at specific positions.

Moreover, in FIG. 3B the letter L indicating that the component is provided on the left hand side, and the letter R indicating that the component is provided on the right hand side, are appended after the reference numerals of each component that is provided as a pair at the left side and right side of the conveyance paths 36, 46, 56.

During manufacture of the ATMs 1, the installation operator of the passing units 50 prepares in advance a passing unit 50 having dimensions corresponding to the opening portion 49*a* of each safe (i.e., the casing 49 of the second unit 40). In the example illustrated in FIG. 3A, the opening portion 49*a* provided to the casing 49 of the second unit 40 is formed with the dimensions of vertical width L49, lateral width W49, and thickness T49. Corresponding to this, the casing 59 of the passing unit 50 is formed with the dimensions of vertical width L50 and lateral width W50, that are slightly smaller dimensions than the vertical width L49 and the lateral width W49 of the opening portion 49*a*. The thickness (height) T50 of the passing unit 50 is formed to be substantially the same dimension as (or a slightly smaller dimension than) the thickness T49 of the opening portion 49*a*. Thus, the casing 59 of the passing unit 50 can be detachably installed inside the opening portion 49*a*.

The passing unit 50 would be a relatively high cost unit. Therefore, it is preferable to install the passing unit 50 only if the thickness T49 of the plate member of the casing 49 is excessively thick (that is, if it is at least thick enough that there is a possibility that a banknote P may stop inside the opening portion 49*a*), rather than always installing the passing units 50 in the opening portions 49*a*.

In the example illustrated in FIG. 3A, the passing unit 50 is configured to have a groove portion 55 at a bottom portion of the casing 59. The groove portion 55 functions as a positioning portion that fixes the passing unit 50 at a specific position by engaging with a projection portion 45 provided at the casing 49 of the second unit 40.

Moreover, in the example illustrated in FIG. 3A, the passing unit 50 is configured such that a connector CN of the left-behind sensor SNR (see FIG. 2 and FIG. 3B) is leading out from the casing 59.

As illustrated in FIG. 3B, the passing unit 50 includes therein the conveyance path 56, the conveyance mechanism 57, and the left-behind sensor SNR.

The conveyance path 56 is a path on which the banknotes P travel. The conveyance path 56 is provided inside the passing unit 50 and connects to the first conveyance path 36 of the first unit 30 and the second conveyance path 46 of the second unit 40. In the following description, the conveyance path 56 will be referred to as the "passing conveyance path 56" when distinguishing the conveyance path 56 from the other conveyance paths 36, 46.

The conveyance mechanism 57 is a component that conveys banknotes P along the passing conveyance path 56. In the following description, the conveyance mechanism 57 will be referred to as the "passing conveyance mechanism 57" when distinguishing the conveyance mechanism 57 from the other conveyance mechanisms 37, 47.

In the example illustrated in FIG. 3B, the passing conveyance mechanism 57 is configured by gear trains G50 and conveyance rollers 58. The gear trains G50 transmit rotation drive force of a motor MO50 of a drive mechanism 67 to the conveyance rollers 58 by engaging with a gear G1 of the drive mechanism 67 provided at the ATM 1 side. Thus, the gear train G50 rotates the conveyance rollers 5*g*. The drive mechanism 67 is configured by the motor MO50 and the gear G1 and is provided at the periphery of the first conveyance path 36 of the ATM 1.

The left-behind sensor SNR is a sensor that detects a banknote P that has been left-behind inside the passing conveyance path 56. In the first exemplary embodiment, the connector CN (see FIG. 4) of the left-behind sensor SNR is configured to have an additional function of detecting connection between the sensor-side connector CNa and the device-side connector CNb.

In the ATM 1, the conveyance distance between the first conveyance mechanism 37 and the second conveyance mechanism 47 varies depending on whether or not the passing unit 50 is installed. Therefore, it is necessary to vary the control of the first conveyance mechanism 37 and the second conveyance mechanism 47 according to whether or not the passing unit 50 is installed. Accordingly, an installation operator performs a registration operation of passing unit installation data (that is, data indicating a state that the passing unit 50 has been installed) as the setting data 3*a* (see FIG. 2) during installation of the passing unit 50 to the opening portion 49*a* (this operation is hereinafter referred to as the "passing unit 50 installation registration").

Thereby, when in use, the ATM can determined as to whether or not passing unit installation data has been registered based on the setting data 3*a*, and can automatically vary control of the first conveyance mechanism 37 and the second conveyance mechanism 47 based on whether or not the passing unit 50 is installed.

Figure 4:
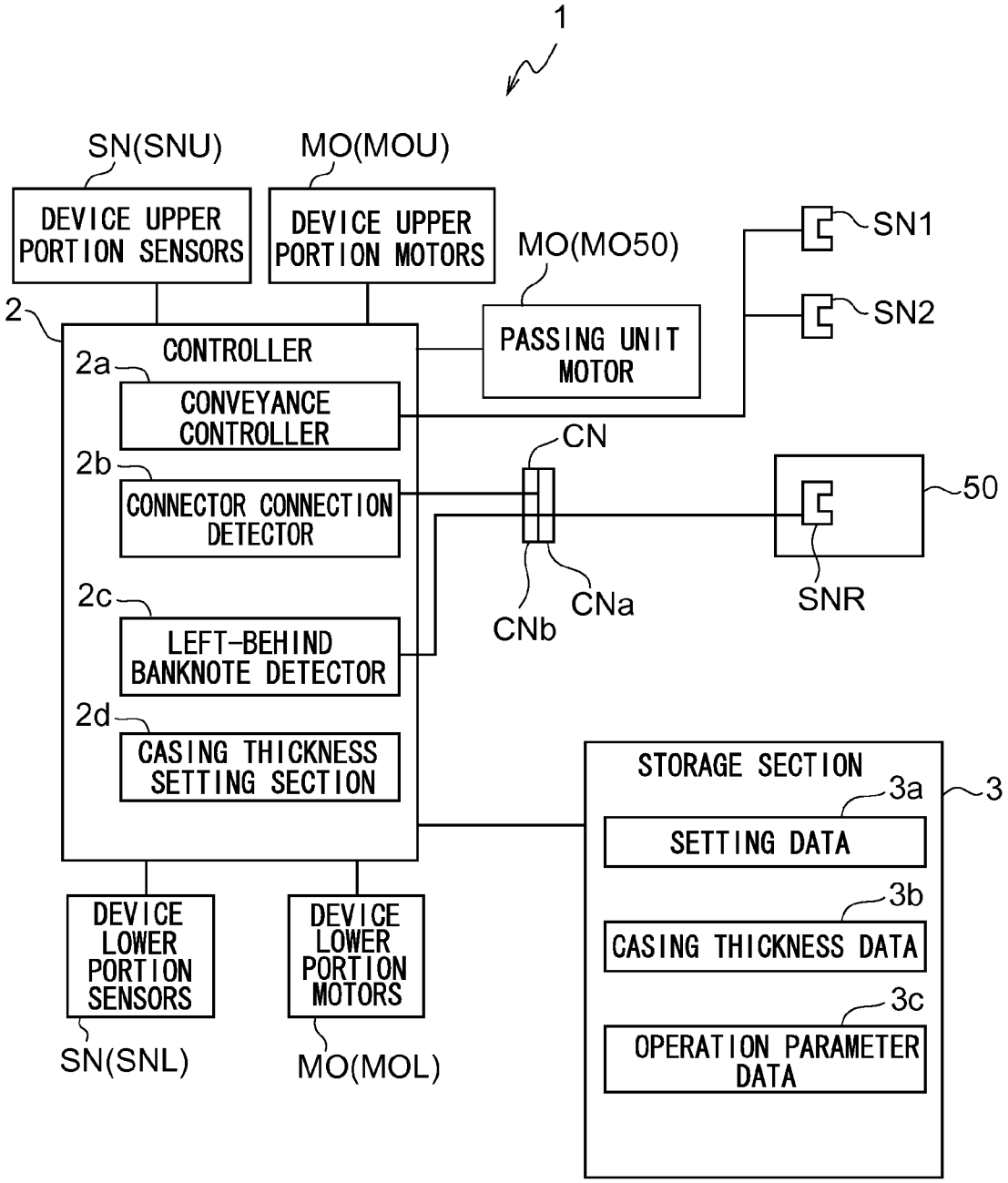
FIG. 4 is a block diagram illustrating a configuration peripheral to a left-behind sensor of the passing unit used in the first exemplary embodiment.
Figure 5:
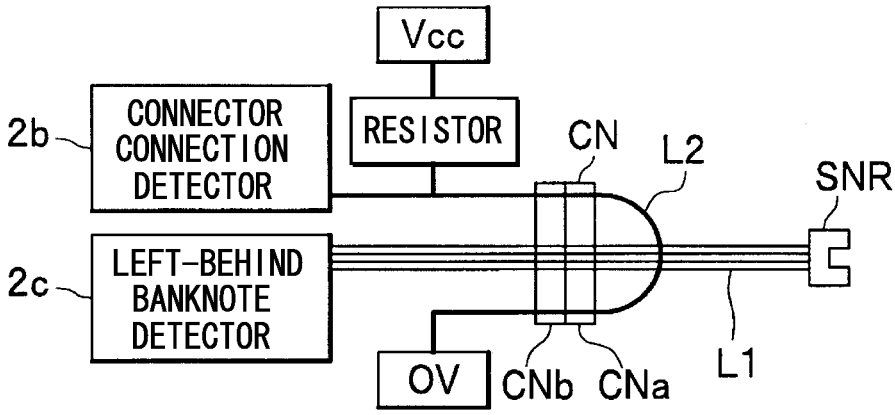
FIG. 5 is another diagram illustrating a configuration peripheral to the left-behind sensor of the passing unit used in the first exemplary embodiment.

However, there is a possibility that the passing unit 50 installation registration may be omitted due to being forgotten by the installation operator. Therefore, as a countermeasure for the case in which the passing unit 50 installation registration has been omitted, the ATM 1 of the first exemplary embodiment has an additional function of automatically identifying the presence or absence of a passing unit 50 according to the presence or absence of connection of the connector CN of the left-behind sensor SNR (see FIG. 4 and FIG. 5) provided to the passing unit 50. FIG. 4 and FIG. 5 illustrate a configuration for implementing this function.

FIG. 4 and FIG. 5 respectively illustrate a configuration peripheral to the left-behind sensor SNR of the passing unit 50 used in the first exemplary embodiment. As illustrated in FIG. 4 and FIG. 5, the connector CN of the left-behind sensor SNR of the passing unit 50 is configured as a connector with a connection detection function. Specifically, as illustrated in FIG. 5, the connector CN includes a line L1 and a line L2.

The line L1 is a line that inputs a detection signal of banknote P from the left-behind sensor SNR into the left-behind banknote detector 2*c*. The line L1 connects the left-behind banknote detector 2*c* and the left-behind sensor SNR.

The line L2 is a line that inputs a connection detection signal of the sensor-side connector CNa and device-side connector CNb into the connector connection detector 2*b*. The line L2 is looped inside the sensor-side connector CNa and is configured so as to connect a power source Vcc to ground (0V) through a resistor and the connector CN by connecting the sensor-side connector CNa and the device-side connector CNb. In such a configuration, the connector CN functioning as a switch such that the connector CN is in an OFF state when the sensor-side connector CNa and the device-side connector CNb are not connected, and is in an ON state when the sensor-side connector CNa and the device-side connector CNb are connected.

The value of voltage applied to the connector connection detector 2*b* is Vcc when the connector CN is in the OFF state, and the value of the applied voltage is 0V when the connector CN is in the ON state. Thus, the connector connection detector 2*b* is able to detect whether or not the connector CN is in the OFF state (a non-connected state of the sensor-side connector CNa and the device-side connector CNb) or the ON state (a connected state of the sensor-side connector CNa and the device-side connector CNb).

Operation of the Banknote Handling Device

Description follows regarding the operation of the ATM 1 with reference to FIG. 1 and FIG. 2. Description is first given regarding the operation of the ATM 1 prior to start of use, and next regarding the operation of the ATM 1 when in use.

In the ATM 1, during an "operation prior to start of use 2", which is described late; the thickness T49 of the casing 49 of the second unit 40 is set as the casing thickness data 1*b*. However, the ATM 1 may inform a maintenance operator, or change the settings of the casing thickness data 3*b*, if a different thickness T49 is detected later based on the travel of the banknotes P.

Operation Prior to Start of Use 1

Hereinafter, description of the "operations prior to start of use" is given for a case in which the installation operation of the passing unit 50 is being performed at a manufacturing facility during manufacture of the ATM 1. However, the installation operation of the passing unit 50 is not limited to during the manufacture of the ATM 1 and may be performed after delivery of the ATM 1 to a financial institution. In such cases, the "operation prior to start of use" is performed at the delivery destination rather than at the manufacturing facility of the ATM 1. Further, in such cases, a maintenance operator for the ATM 1 may be the installation operator for the passing unit 50.

The installation operation of the passing unit 50 is performed if necessary during manufacture of the ATM 1.

In such cases, the installation operator installs the passing unit 50 in the opening portion 49*a* of the casing 49 of the second unit 40, and connects the sensor-side connector CNa provided at the left-behind sensor SNR (see FIG. 4 and FIG. 5) and the device-side connector CNb provided at the ATM 1.

When this is performed, the connector connection detector 2*b* (see FIG. 2, FIG. 4 and FIG. 5) of the ATM 1 detects the connection of the sensor-side connector CNa and the device-side connector CNb. A connected state of the sensor-side connector CNa and the device-side connector CNb obviously means an installed state of the passing unit 50 to the ATM 1.

In a case in which the connector connection detector 2*b* has detected the connection of the sensor-side connector CNa to the device-side connector CNb, the current state of the ATM 1 is determined as a passing unit 50 installed state, and the passing unit installation data (that is, data indicating the installed state of the passing unit 50) is registered as the setting data 3*a*. Therefore, the connector connection detector 2*b* of the ATM 1 can automatically perform the "passing unit 50 installation registration" mentioned above, in place of the installation operator.

In such cases, the conveyance controller 2*a* of the ATM 1 performs operation control for the passing unit 50 installed state on the first conveyance mechanism 37, the second conveyance mechanism 47, and the passing conveyance mechanism 57 of the passing unit 50 in the "operation prior to start of use 3" and the "operation when in use", which are described later. For example, in such cases, the conveyance controller 2*a* identifies the thickness T49 of the plate member of the casing 49 based on the casing thickness data 3*b* that has been set before use, determines the current state of the ATM 1 as the passing unit 50 installed state, and identifies parameters corresponding to the thickness T49 and the passing unit 50 installed state based on the operation parameter data 3*c*, and controls the operation of the conveyance mechanisms 37, 47, 57 based on the identified parameters.

Accordingly, in a case in which the sensor-side connector CNa of the left-behind sensor SNR provided to the passing unit 50 and the device-side connector CNb are connected, the ATM 1 is capable of automatically determining the current state of the ATM 1 as the passing unit 50 installed state, and controlling the operation of the conveyance mechanisms 37, 47, 57 based on the optimal parameters.

Operation Prior to Start of Use 2

During the manufacture of the ATM 1, settings for the operation of each section are performed after completion of assembly.

When this is performed, data such as the casing thickness data 3*b* and the operation parameter data 3*c* are stored in the storage section 3 of the ATM 1.

Description is given hereinafter for a case in which the casing thickness data 3*b* is, for example, a numerical value such as "x mm", that indicates the thickness T49 of the plate member of the casing 49 determined at the design stage of the second unit 40. The casing thickness data 3*b* is registered via the casing thickness setting section 2*d*.

Moreover, description is given hereinafter for a case in which the operation parameter data 3*c* is configured from plural sets of data corresponding to plural patterns for different cases, so that it can be commonly used for various types of second units 40 that have different thickness T49 values.

For example, the operation parameter data 3*c* is described to be configured with exhaustive sets of parameters, including a parameter pattern for the thickness T49 is "x mm" and a passing unit 50 "being installed", a parameter pattern for the thickness T49 is "x mm" and a passing unit 50 "not being installed", a parameter pattern for the thickness T49 is "y mm" and a passing unit 50 "being installed", a parameter pattern for the thickness T49 is "y mm" and a passing unit 50 "not being installed", and the like.

When conveying the banknotes P, the conveyance controller 2*a* of the ATM 1 refers to the casing thickness data 3*b* in order to identify the value of the thickness T49, refers to the setting data 3*a* in order to identify whether or not the passing unit 50 has been installed, selects the corresponding parameter pattern from the operation parameter data 3*c*, and controls operation of the conveyance mechanisms 37, 47, 57 using the selected parameter pattern. For example, if the conveyance controller 2*a* identifies that the thickness T49 is "x mm" by referring to the casing thickness data 3*b*, and identifies that passing unit 50 has been installed by referring to the setting data 3*a* and, the conveyance controller 2*a* selects the parameter pattern for the thickness T49 of "x mm" and a passing unit 50 "being installed" from the operation parameter data 3*c*, and controls the operation of the conveyance mechanisms 37, 47, 57 using the selected parameter pattern.

Here, description is given for a case in which the "operation parameter data 3*c*" includes data defining a "theoretical conveyance duration for the thickness T49", which is described later, as the data defining the "detection duration" mentioned above.

Moreover, in a case in which the passing unit 50 has been installed in the opening portion 49*a* of the ATM 1 during "operation prior to start of use 1", the passing unit installation data (that is, data indicating a state in which the passing unit 50 has been installed) is registered as the setting data 3*a*. Accordingly, the case in which the passing unit installation data has been registered as the setting data 3*a* indicates the case of a passing unit 50 "being installed".

Operation Prior to Start of Use 3

After settings for operation of each section of the ATM 1 have been completed, checking the operation of each section is performed.

In the ATM 1, checking for whether or not there is incorrect settings registered in the device as the setting data 3*a* (for example, settings of a non-installed state for the passing unit 50), and checking for whether or not banknote P conveyance errors occur (for example jams, errors of non-arrival within a specific duration for a specific conveyance interval) is performed by conveying a banknote P inside the device.

Description is given for a case in which checking for whether or not there is incorrect settings, and checking for whether or not banknote P conveyance errors occur inside the passing unit 50 in the ATM 1, is performed by conveying a banknote P from the banknote input/output section 31 towards the cassette 41 for the corresponding denomination while the conveyance controller 2*a* monitors the conveyance duration of the banknote P inside the passing unit 50. The detection of the "conveyance duration of the banknote P inside the passing unit 50" is performed by the conveyance controller 2*a* detecting a pass-through timing of the banknote P based on a detection signal of the banknote P output from the first conveyance sensor SN1 and a detection signal of the banknote P output from the second conveyance sensor SN2.

During checking the operation of each section of the ATM 1, the conveyance controller 2*a* reads from the storage section 3 the casing thickness data 3*b* and the setting data 3*a* that have been set in advance, and identifies the value of the thickness T49 of the casing 49 by referring to the casing thickness data 3*b*. Further, the conveyance controller 2*a* also identifies the installation state of the passing unit 50 by referring to the setting data 3*a*. The conveyance controller 2*a* then selects the corresponding parameter pattern from the operation parameter data 3*c* according to the identified value of the thickness T49 of the casing 49 and the installation state of the passing unit 50, and uses the selected parameter pattern to control the operation of the conveyance mechanisms 37, 47, 57. The "installation state of the passing unit 50" indicates either the passing unit 50 "being installed" or the passing unit 50 "not being installed".

In the "operation prior to start of use 1" described above, if the connector connection detector 2*b* has detected the connection of the sensor-side connector CNa to the device-side connector CNb, the passing unit installation data is registered as the setting data 3*a*. In such cases, the conveyance controller 2*a* selects from the plural parameter patterns registered in the operation parameter data 3*c* the parameter pattern for the case of the passing unit 50 installation "being installed".

For example, the control of the operation of the conveyance mechanisms 37, 47, 57 by the conveyance controller 2*a* is performed by monitoring the banknote P conveyance duration, as described below.

Firstly, for example, the conveyance controller 2*a* of the ATM 1 computes the detection duration. As mentioned above, the "detection duration" is a duration that serves as a threshold value for detection of the occurrence of a banknote P conveyance error (for example, a jam or an error of non-arrival within a specific duration for a specific conveyance interval). Obviously, the "detection duration" becomes longer as the distance of the conveyance interval of the detection target becomes longer.

The "detection duration" is computed by adding a permissible retention duration (referred to below as the "wait time") of a banknote P to the theoretical conveyance duration for a specific conveyance interval. Accordingly, the detection duration for detection of a conveyance error inside the passing unit 50 (referred to below as the "unit internal error detection duration") is computed by adding the wait time to the theoretical conveyance duration required from the first conveyance sensor SN1 becoming an ON state to the second conveyance sensor SN2 becoming an ON state (referred to below as the "theoretical conveyance duration between sensors").

Here, the conveyance controller 2*a* computes the "unit internal error detection duration" by treating a section at which the passing conveyance path 56 of the passing unit 50 is provided as the "specific conveyance interval". Further, the section where the passing conveyance path 56 of the passing unit 50 is provided is equivalent to an interval between the first conveyance sensor SN1 and the second conveyance sensor SN2 (hereinafter referred to as "between sensors"), and the length of this interval is treated as having the same length as the thickness T49 of the plate member of the casing 49.

The conveyance controller 2*a* identified the value of the thickness T49 of the plate member of the casing 49 by referring to the casing thickness data 3*b*, and identifies the installation state of the passing unit 50 by referring to the setting data 3*a*. The conveyance controller 2*a* then identifies from the operation parameter data 3*c* the theoretical conveyance duration for the thickness T49 defined by the operation parameter data 3*c*, as the parameter pattern corresponding to the value of the identified thickness T49 of the casing 49 and the installation state of the passing unit 50. The conveyance controller 2*a* further computes the unit internal error detection duration by adding the wait time to the theoretical conveyance duration for the thickness T49.

After computing the unit internal error detection duration, the conveyance controller 2*a* drives the first conveyance mechanism 37 and the second conveyance mechanism 47, and also drives the passing conveyance mechanism 57, if the passing unit 50 has been installed, and conveys the banknote P from the banknote input/output section 31 towards the cassette 41 for the corresponding denomination.

During this operation, the banknote P travels through the interval between the first conveyance sensor SN1 and the second conveyance sensor SN2 (namely, between the sensors). When this occurs, the conveyance controller 2*a* monitors the conveyance duration of the banknote P between the sensors by comparing the conveyance duration of the banknote P between the sensors against the unit internal error detection duration.

In a case in which the conveyance duration of the banknote P between the sensors exceeds the unit internal error detection duration, the conveyance controller 2*a* determines and detects that a banknote P conveyance error has occurred inside the passing unit 50.

In this case, the conveyance controller 2*a* stops the first conveyance mechanism 37 and the second conveyance mechanism 47, and also stops the passing conveyance mechanism 57 if the passing unit 50 has been installed. However, is the banknote P is left-behind inside the opening portion 49*a* (or the passing unit 50), the conveyance controller 2*a* conveys the banknote P to the outside of the opening portion 49*a* (or the passing unit 50), and then stops the conveyance mechanisms 37, 47, 57.

Specifically, the left-behind banknote detector 2*c* of the ATM 1 monitors whether or not a banknote P is left-behind inside the opening portion 49*a* (or the passing unit 50) based on a detection signal from the left-behind sensor SNR. The left-behind banknote detector 2*c* outputs to the conveyance controller 2*a* a notification signal of a value that corresponds to whether or not there is a banknote P left-behind inside the opening portion 49*a* (or the passing unit 50). In a case of stopping the conveyance mechanisms 37, 47, 57, the conveyance controller 2*a* determines whether or not there is a banknote P left-behind inside the opening portion 49*a* (or the passing unit 50) based on the value of the notification signal output from the left-behind banknote detector 2*c*. If there is indeed a banknote P left-behind inside the passing unit 50, the conveyance controller 2*a* activates the conveyance mechanisms 37, 47, 57 and conveys the banknote P until the banknote P reaches the outside of the opening portion 49*a* (or the passing unit 50), and then stops the conveyance mechanisms 37, 47, 57.

Thus, the conveyance controller 2*a* can control the operation of the conveyance mechanisms 37, 47, 57 using the optimal parameters according to the value of the thickness T49 of the casing 49 and the installation state of the passing unit 50.

The ATM 1 is capable of predicting in advance that there is a cause of conveyance errors if, for example, the connection of the connectors has been omitted, or the passing unit installation registration has been omitted. Accordingly, if there is such a cause of conveyance errors prior to the start of use, the ATM 1 is capable of navigating a maintenance operator to resolve the cause of conveyance errors. In this way, since it is possible to avoid the ATM 1 going into a suspension state, the operational efficiency of the ATM 1 can be improved.

Operation when in Use

Description of the "operation when in use" is given for a case in which the ATM 1 is delivered to a financial institution and used in an ATM corner of the financial institution. Operation when in use is mainly performed by the conveyance controller 2*a*. Here, pay-in operation is described as an example of the operation when in use. Further, description is given for a case in which the passing unit 50 is installed in the opening portion 49*a*.

Similarly to in the "operation prior to start of use 3", the conveyance controller 2*a* of the ATM 1 reads from the storage section 3 the casing thickness data 3*b* and the setting data 3*a* that have been set in advance, identifies the value of the thickness T49 by referring to the casing thickness data 3*b*, and identifies the installation state of the passing unit 50 by referring to the setting data 3*a*. The conveyance controller 2*a* then selects from the operation parameter data 3*c* the parameter pattern corresponding to the identified value of the thickness T49 and the installation state of the passing unit 50. From thereon, the conveyance controller 2*a* controls operation of the conveyance mechanisms 37, 47, 57 using the selected parameter pattern.

For example, during pay-in operation, a user of the ATM 1 (here, a customer of the financial institution) firstly selects "paying in transaction" as the transaction type on the display/operation section 12. Next, the user inserts a cash card into the card insertion port 14, and inputs banknotes P into the banknote input/output port 15.

When the banknotes P have been input into the banknote input/output port 15, the banknote input/output section 31 of the ATM 1 feeds the banknotes P onto the first conveyance path 36 one by one, and the first conveyance mechanism 37 conveys the banknotes P along the first conveyance path 36. The classification section 32 automatically counts the number of the banknotes P while classifying the respective banknotes P. At this stage, the conveyance controller 2*a* of the ATM 1 used the parameter pattern selected in advance to control the operation of the first conveyance mechanism 37.

The ATM 1 then houses banknotes P that have been classified as genuine notes inside the temporary holding section 33, and displays the total value of the input banknotes P (referred to below as "input value") on the display/operation section 12.

If the displayed input value is correct, the user may press an OK button (not illustrated in the drawings) on the display/operation section 12. In response, the ATM 1 communicates with a host computer (not illustrated in the drawings) of the financial institution and performs pay-in processing of the amount of the input value to a bank account indicated by the cash card.

In this case, the ATM 1 feeds out the banknotes P housed inside the temporary holding section 33 onto the first conveyance path 36 one by one, and the first conveyance mechanism 37 conveys each of the banknotes P along the first conveyance path 36 towards the second unit 40. As a result, the banknotes P travel through the passing conveyance path 56 of the passing unit 50. In this operation, the passing conveyance mechanism 57 of the passing unit 50 conveys the banknotes P towards the second conveyance mechanism 47 of the second unit 40 from partway. During this operation, the conveyance controller 2*a* of the ATM 1 uses the parameter pattern selected in advance to control the operation of the conveyance mechanisms 37, 47, 57.

Next, the second conveyance mechanism 47 of the ATM 1 conveys each of the banknotes P along the second conveyance path 46 to the cassettes 41 of the corresponding denominations, and houses each of the banknotes P inside the cassettes 41 of the corresponding denominations.

Features of the Banknote Handling Device (1) In the first exemplary embodiment, the passing conveyance mechanism 57 and the left-behind sensor SNR are integrally configured as the passing unit 50. The passing unit 50 preferably has dimensions that correspond to the opening portions 49*a* of each of the safes (the casing 49 of the second unit 40).

The passing conveyance mechanism 57 and the left-behind sensor SNR can be installed inside the opening portion 49*a* of the safe 49 of the ATM 1 simply by installing the passing unit 50 inside the opening portion 49*a* of the safe 49. Since the number of components that are handled is reduced, the burden on an installation operator to be careful so that confusion of members does not occur while manufacturing the ATM 1 is lessened.

As a result, in the ATM 1, it is possible to lessen the effort involved in installing the passing conveyance mechanism 57 and the left-behind sensor SNR inside the opening portion 49*a* of the safe 49 corresponding to each of the safes 49 having different thicknesses T49 of the plate members. Accordingly, the ATM 1 is capable of addressing the issue encountered in conventional banknote handling devices discussed above (namely, the issue of the effort required to install a passing conveyance mechanism and a left-behind sensor in the opening portion of a safe corresponding to each of the safes having different thicknesses of plate members).

(2) In the present exemplary embodiment, the connector connection detector 2*b* (see FIG. 2, FIG. 4 and FIG. 5) functions as a detection mechanism that automatically detects the installation of the passing unit 50 (namely, installation of the passing conveyance mechanism 57).

Thus, in the ATM 1, the connector connection detector 2*b* of the ATM 1 determines the current state of the ATM 1 as a passing unit 50 installed state if the sensor-side connector CNa and the device-side connector CNb are connected, and enables registration of the passing unit installation data in the setting data 3 on behalf of the installation operator.

Therefore, the installation operator is not required to invariably perform the installation registration of the passing conveyance mechanism 57. Accordingly, the ATM 1 is capable of addressing the Additional Issue 1 discussed above (namely, the issue that the installation operator is forced to perform an installation registration of a passing conveyance mechanism).

Moreover, in the first exemplary embodiment, if the connector connection detector 2*b* has detected the connection between the sensor-side connector CNa and the device-side connector CNb, the conveyance controller 2*a* performs operation control for the passing unit 50 installed state on the first conveyance mechanism 37, the second conveyance mechanism 47, and the passing conveyance mechanism 57 of the passing unit 50.

Therefore, the ATM 1 is capable of automatically varying the control of the first conveyance mechanism 37, the second conveyance mechanism 47 and the passing conveyance mechanism 57. As a result, it is possible to avoid the occurrence of banknote P conveyance errors in the ATM 1 even if the installation registration of the passing conveyance mechanism 57 is omitted. Accordingly, the ATM 1 is capable of addressing the Additional Issue 2 and the Additional Issue 3 discussed above (namely, the issues that banknote conveyance errors may occur if the installation registration of the passing conveyance mechanism is omitted or if an attachment of a detection mechanism is omitted).

As described above, according to the banknote handling device 1 of the first exemplary embodiment, it is possible to reduce the effort involved in installing the passing conveyance mechanism 57 and the left-behind sensor SNR to the opening portion 49*a* of the safe 49 corresponding to each of the safes 49 with different thicknesses T49 of the plate members.

Modified Example of the Banknote Handling Device

Figure 6:
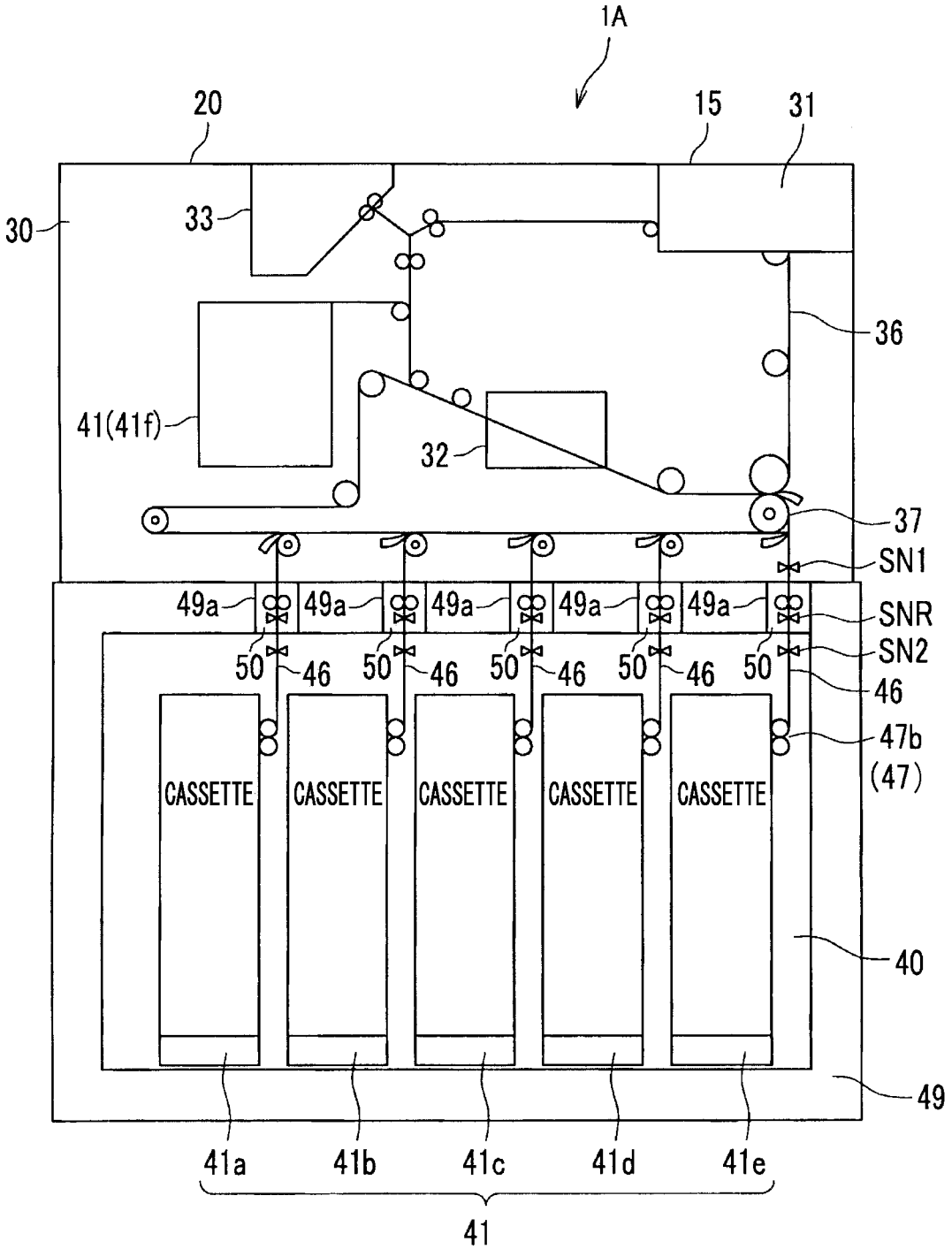
FIG. 6 is a diagram illustrating a configuration of a modified example of a banknote handling device according to the first exemplary embodiment.

The ATM 1 of the first exemplary embodiment may be modified, for example, as illustrated in FIG. 6. FIG. 6 illustrates a modified configuration of a banknote handling device according to the first exemplary embodiment. The banknote handling device 1 illustrated in FIG. 6 is referred to below as the "banknote handling device 1A".

As illustrated in FIG. 6, in the banknote handling device 1A plural (five in the example illustrated in FIG. 6) opening portions 49*a* are provided in the casing 49 of the second unit 40, corresponding to respective cassettes 41*a* to 41*e* that are provided inside the second unit 40. The first conveyance path 36 is configured as branching towards each of the opening portions 49*a*.

The banknote handling device 1A is configured such that the passing unit 50 is installed inside each of the opening portions 49*a*, plural second conveyance paths 46 that respectively link the opening portions 49*a* with the cassettes 41*a* to 41*e* are provided, and the second conveyance mechanism 47 is provided corresponding to each of the second conveyance paths 46. In the example illustrated in FIG. 6, the second conveyance mechanisms 47 are configured from only the separation/stacking portions 47*b*. The banknote handling device 1A according to this modified example is capable of achieving similar effects as the ATM 1 according to the first exemplary embodiment.

Second Exemplary Embodiment

In the ATM 1 of the first exemplary embodiment, the measurement precision of the conveyance duration of the banknotes P drops between the sensors if the precision of travel of the passing conveyance path 56 is poor. Accordingly, it is preferable to confirm the precision of travel of the passing conveyance path 56 in advance (i.e., prior to performing the "operation prior to start of use 3", namely, the operation during checking the operation of each section). However, in the ATM 1 it is not possible to confirm the precision of travel of the passing conveyance path 56 in advance.

The second exemplary embodiment accordingly provides an ATM 1B that can confirm the precision of travel of the passing conveyance path 56 in advance.

Further, in the ATM 1 of the first exemplary embodiment, if the connection of the connector CN of the left-behind sensor SNR and the installation registration of the passing unit 50 are both omitted, or if an inappropriate installation registration of the passing unit 50 has been performed, banknote P conveyance errors readily occur inside the passing unit 50 and the ATM 1 easily goes into suspension, and a time may be required for operation checking.

The second exemplary embodiment accordingly provides the ATM 1B that is capable of preventing the occurrence of banknote P conveyance errors inside the passing unit 50 and of continuously performing operation checking, even if both the connection of the connector CN of the left-behind sensor SNR and the installation registration of the passing unit 50 are omitted, or when inappropriate passing unit 50 installation registration has been performed.

Figure 7:
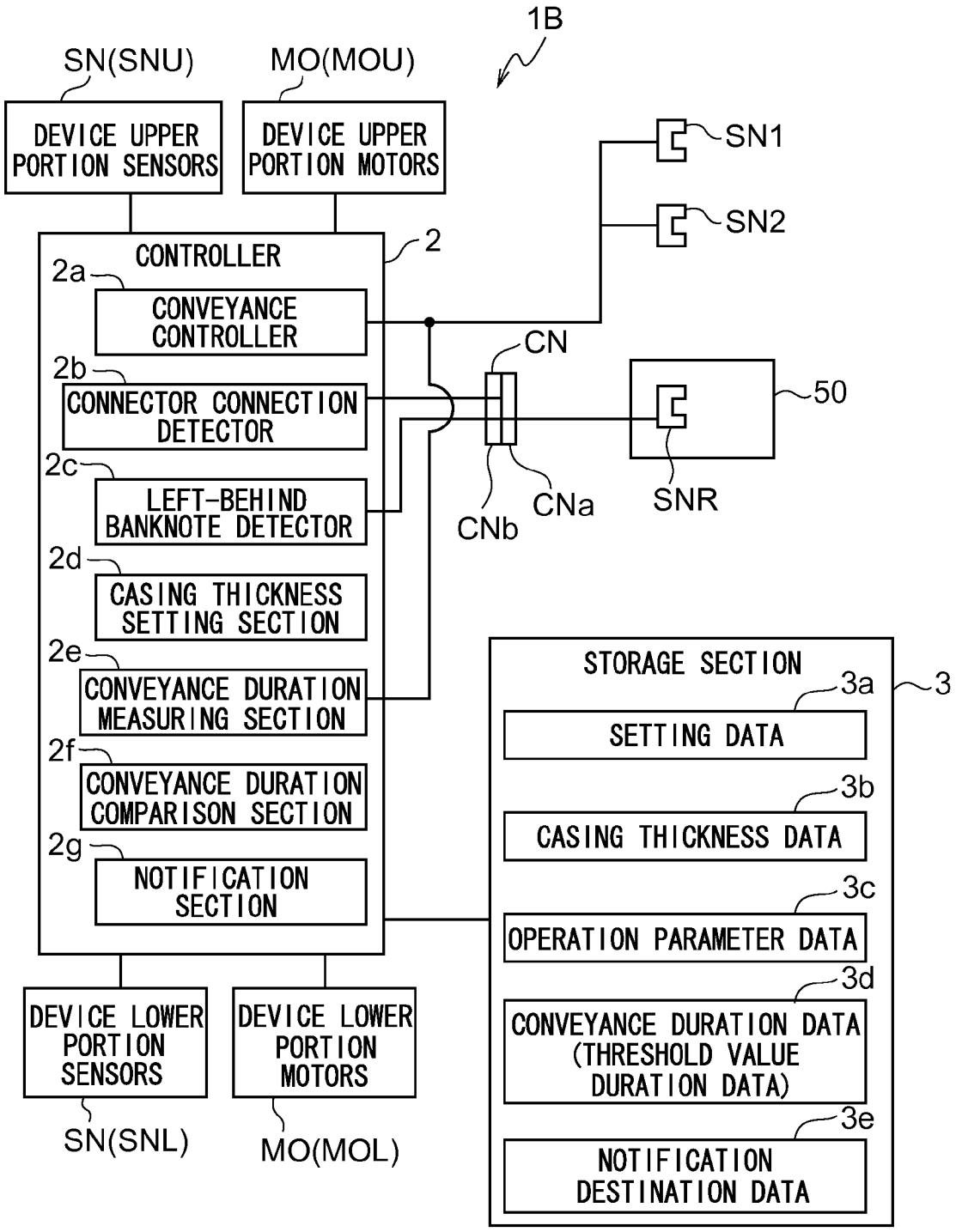
FIG. 7 is a diagram illustrating a configuration of a banknote handling device according to a second exemplary embodiment.

Description follows regarding the configuration of the ATM 1B of the second exemplary embodiment with reference to FIG. 7. FIG. 7 illustrates the configuration of a banknote handling device according to the second exemplary embodiment.

In contrast to the ATM 1 (see FIG. 4) of the first exemplary embodiment, the controller 2 the ATM 1B according to the second exemplary embodiment is configured such that it further functions as a conveyance duration measurement section 2*e*, a conveyance duration comparison section 2*f*, and a notification section 2*g* Further, in the ATM 1B, conveyance duration data 3*d* and notification destination data 3*e* are stored in advance in the storage section 3.

The conveyance duration measurement section 2*e* is a functional unit that measures the conveyance duration between the sensors (namely, the conveyance duration of a banknote P between the first conveyance sensor SN1 and the second conveyance sensor SN2).

The conveyance duration comparison section 2*f* is a functional unit that compares the conveyance duration between the sensors measured by the conveyance duration measurement section 2*e* with the conveyance duration data 3*d* that is set in advance.

The notification section 2*g* is a functional unit that gives notification of information that needs to be conveyed to an installation operator or maintenance operator of the passing unit 50. The notification by the notification section 2*g* may be realized by emitting sound from the speaker 13 if an installation operator is carrying out installation or a maintenance operator is carrying out maintenance (for example, when the door of the ATM 1B is open), or by displaying information on the display/operation section 12 (or on a display/operation section for maintenance, which is not illustrated in the drawings, provided inside the ATM 1B). Alternatively, notification may be realized by the notification section 2*g* by sending an e-mail to a terminal device (not illustrated in the drawings) held by the maintenance operator.

The conveyance duration data 3*d* is data that defines a "theoretical conveyance duration between sensors" for a banknote P (a theoretical conveyance duration required from the first conveyance sensor SN1 turning to an ON state to the second conveyance sensor SN2 turning to an ON state) corresponding to the thickness T49 value of the casing 49. The conveyance duration data 3*d* may also be used as data expressing a threshold value duration (referred to below as "threshold value duration data") for determining whether or not the passing unit 50 is has been installed in the opening portion 49*a* based on the conveyance duration of the banknote P between the sensors.

The notification destination data 3*e* is an e-mail address used in the case in which the information that needs to be conveyed is notified to a maintenance operator by e-mail.

Description follows regarding the operation of the ATM 1B. The operation of the ATM 1B differs from that of the ATM 1 of the first exemplary embodiment in the point that the following "travel precision checking based on the conveyance duration between the sensors" is performed between the "operation prior to start of use 1" (namely, the operation during the passing unit 50 installation) and the "operation prior to start of use 2" (namely, the operation during operation settings for each section), or between the "operation prior to start of use 2" (namely, the operation during operation settings for each section) and the "operation prior to start of use 3" (namely, the operation during checking the operation of each section). Here, the "travel precision checking based on the conveyance duration between the sensors" of the ATM 1B is described, and detailed explanation is omitted for the operation similar to that of the ATM 1 of the first exemplary embodiment.

Travel Precision Checking Based on the Conveyance Duration Between the Sensors

The ATM 1B performs the following operation between the "operation prior to start of use 1" (namely, the operation during the passing unit 50 installation) and the "operation prior to start of use 2" (namely, the operation during operation settings for each section), or between the "operation prior to start of use 2" (namely, the operation during operation settings for each section) and the "operation prior to start of use 3" (namely, the operation during checking the operation of each section).

Here, description is given for a case in which the conveyance duration data 3*d* is stored in advance in the storage section 3 associated with various thickness T49 values including parameters for a case in which the thickness T49 value is indeterminate. Further, description is given for a case in which the passing unit 50 has been installed and the passing unit installation data has been registered as the setting data 3*a*.

The conveyance controller 2*a* of the ATM 1B assumes that the thickness T49 value of the casing 49 is indeterminate, and controls the operation of the conveyance mechanisms 37, 47, 57 using the parameters for the case in which the thickness T49 value is indeterminate. The ATM 1B thus starts conveyance of a banknote P. Hereinafter, description is given for a case in which the ATM 1B conveys a single banknote P from the banknote input/output section 31 towards the cassette 41 of the corresponding denomination.

In this operation, the banknote P travels between the sensors (the interval between the first conveyance sensor SN1 and the second conveyance sensor SN2). During this operation, the conveyance duration measurement section 2*e* measures the conveyance duration between the sensors. The conveyance duration comparison section 2*f* then identifies the thickness T49 of the casing 49 that corresponds to the conveyance duration between the sensors measured by the conveyance duration measurement section 2*e*, by referring to the conveyance duration data 3*d* is stored in advance in the storage section 3.

The conveyance duration comparison section 2*f* notifies the casing thickness setting section 2*d* with the identified thickness T49 of the casing 49. The casing thickness setting section 2*d* treats the notified thickness T49 of the casing 49 as a provisional thickness T49 of the casing 49, and temporarily stores provisional casing thickness data 3*b* expressing this value in the storage section 3.

Next, the conveyance controller 2*a* of the ATM 1B identifies the provisional thickness T49 value of the casing 49 by referring to the provisional casing thickness data 3*b*, and identifies the installation state of the passing unit 50 by referring to the setting data 3*a*. In this example, the passing unit installation data is registered as the setting data 3*a* and, therefore, the installation state of the passing unit 50 is determined as the passing unit 50 "being installed". Based on the operation parameter data 3*c*, the conveyance controller 2*a* selects the parameter pattern corresponding to the identified provisional thickness T49 value of the casing 49 and the installation state of the passing unit 50, and controls operation of the conveyance mechanisms 37, 47, 57 using the selected parameter pattern. The ATM 1B thereby starts conveyance of a subsequent banknote P, and continues measurement of the conveyance duration between the sensors.

If the provisional thickness T49 of the casing 49 is different from the setting values, this indicates that the precision of travel of the passing conveyance path 56 is poor. Accordingly, it is preferable give notification to the installation operator of the provisional thickness T49 of the casing 49 at the end of the travel precision checking in the ATM 1B. In the second exemplary embodiment, the notification section 2*g* gives notification to the installation operator of the provisional thickness T49 of the casing 49 at the end of the travel precision checking. The installation operator may verify the precision of travel of the passing conveyance path 56 in advance by comparing the notified provisional thickness T49 of the casing 49 against the setting values.

It is necessary for the ATM 1B to convey the banknote P at an appropriate conveyance speed when measuring the conveyance duration of a banknote P between the sensors in the "travel precision checking based on the conveyance duration between the sensors". An "appropriate conveyance speed" is a speed for which high measurement precision can be obtained, and which is different from the conveyance speed during normal use. Generally, the measurement precision can be increased by reducing the speed. However, extremely reducing the speed may lower the measurement precision due to the characteristics of an actuator (such as larger vibrations or occurrence of resonance). Accordingly, there is an "appropriate conveyance speed" in order to increase the measurement precision. In the ATM 1B, the appropriate conveyance speed is derived in advance, and the conveyance duration between the sensors is measured by conveying the banknote P at the appropriate conveyance speed while measuring the conveyance duration of the banknote P between the sensors.

The ATM 1B may be configured to slow down the banknote P conveyance speed only when measuring the conveyance duration of the banknote P between the sensors. In this way, the ATM 1B may not be insusceptible to negative impact from, for example, sticking or catching during conveyance of the banknote P, and the measurement precision of the conveyance duration of the banknote P may be improved.

Further, there is the possibility an error occurs in the measurement precision of the banknote P conveyance duration if the ATM 1B only measures the conveyance duration of a single banknote P during the measurement of the conveyance duration of the banknotes P between the sensors. Therefore, it is preferable to successively convey plural banknotes P, measure the conveyance duration of each of the banknotes P, and compute the average value thereof. In this way, the ATM 1B may be insusceptible to negative impact from sticking or catching during conveyance of the banknotes P and enables the measurement precision of the conveyance duration of the banknotes P to be increased.

The ATM 1B may incorrectly detect the thickness T49 of the casing 49 during the "travel precision checking based on the conveyance duration between the sensors" for the factors listed below. Therefore, it is preferable to avoid such incorrect detection by implementing the following solutions in the ATM 1B.

Factor 1

Banknotes P in poor condition (for example, torn, creased or dirty) are included among the media in use. If the condition of a banknote P is poor (for example, torn, creased or dirty), the detected conveyance duration or medium width may become erratic. Therefore, the ATM 1B may incorrectly detect the thickness T49 of the casing 49 during the "travel precision checking based on the conveyance duration between the sensors".

Solution

The better the condition of a banknote P (for example, not torn, creased or dirty) in the media in use, the more readily the conveyance duration or the detected medium width match their theoretical values. Therefore, it is preferable to use banknotes P that are in good condition for the media in use. It is preferable to measure the conveyance duration in the ATM 1B by conveying such clean banknotes P on the flat conveyance paths 36, 46, 56.

Factor 2

In the ATM 1B, the detected conveyance duration may become erratic if banknote P conveyance errors such as skewing or sticking occur in the banknotes P during conveyance. Therefore, the ATM 1B may incorrectly detect the thickness T49 of the casing 49 the "travel precision checking based on the conveyance duration between the sensors".

Solution

The ATM 1B may be configured to detect skewing or sticking based on a detection timing of the first conveyance sensors SN1, SN2 and the left-behind sensor SNR which are provided at the left and right in the ATM 1B. Specifically, the first conveyance sensor SN1 and the second conveyance sensor SN2 are respectively provided at the left and right (L and R). Therefore, the ATM 1B may measure the conveyance duration between the first conveyance sensor SN1 (L) and the second conveyance sensor SN2 (L), and the conveyance duration between the first conveyance sensor SN1 (R) and the second conveyance sensor SN2 (R), and detect that skewing, sticking or the like exists if there is a significant difference between the measurement durations for the left and for the right.

Factor 3

In the ATM 1B, if there is unevenness in the conveyance paths 36, 46, 56, the detected conveyance duration and medium width become erratic. Therefore, the ATM 1B may incorrectly detect the thickness T49 of the casing 49 during the "travel precision checking based on the conveyance duration between the sensors".

Solution

The conveyance paths 36, 46, 56 are preferably configured with a flat profile. Thereby, the ATM 1B may stably convey the banknote P, make conveyance errors less liable to occur, detect banknotes P with a short medium width as creased banknotes P, or detect banknotes P with a long medium width as plural banknotes P running in an overlapped state.

Factor 4

In the ATM 1B, the first unit 30, the passing unit 50, and the second unit 40 are configured as different units and separated into different bodies, and the first conveyance sensor SN1 and the second conveyance sensor SN2 are provided at different units. Therefore, the conveyance performance accordingly drops in the ATM 1B if either one or both of the positional alignment between the first conveyance path 36 and the passing conveyance path 56 or the positional alignment between the passing conveyance path 56 and the second conveyance path 46 are misaligned, and the ATM 1B is not able to detect this drop in conveyance performance. Accordingly, the ATM 1B may incorrectly detect the thickness T49 of the casing 49 during the "travel precision checking based on the conveyance duration between the sensors".

Solution

In the ATM 1B, it is preferable to align the first conveyance path 36 and the passing conveyance path 56, and to align the passing conveyance path 56 and the second conveyance path 46. Thereby, incorrect detection of the thickness T49 of the casing 49 becomes less liable to occur.

Moreover, the length of the passing conveyance path 56 (the thickness T49 of the casing 49) is preferably configured in increments of several tens of mm. Due to this configuration, since the ATM 1B detects the conveyance duration and medium width of the banknotes P corresponding to the length of the passing conveyance path 56 in increments of several tens of mm, incorrect detection of the thickness T49 of the casing 49 accordingly becomes less liable to occur.

Note that the ATM 1B preferably operates as follows in a case in which both the connection of the connector CN of the left-behind sensor SNR and the installation registration of the passing unit 50 are omitted, or in a case in which inappropriate installation registration of the passing unit 50 is performed.

The conveyance controller 2*a* of the ATM 1B activates the conveyance mechanisms 37, 47, 57 using initial values of the parameters in order to convey the banknotes P.

Then, the conveyance duration measurement section 2*e* measures the conveyance duration between the sensors each time a banknote P travels between the sensors, and notifies the measured conveyance duration between the sensors to the conveyance duration comparison section 2*f*.

The conveyance duration comparison section 2*f* compares the conveyance duration between the sensors measured by the conveyance duration measurement section 2*e* against the conveyance duration data 3*d* that has been stored in advance in the storage section 3 and makes determination as to whether or not the measured conveyance duration of the banknote P is equal to or greater than the predetermined conveyance duration data 3*d*. The conveyance duration comparison section 2*f* notifies the determination result to the conveyance controller 2*a*.

Next, the conveyance controller 2*a* determines the current state of the ATM 1B as a passing unit 50 installed state if the determination result notified from the conveyance duration comparison section 2*f* is that the measured conveyance duration of the banknote P is equal to or greater than the predetermined conveyance duration data 3*d*. Moreover, if the current state of the ATM 1B has been registered as a passing unit 50 non-installed state by the setting data 3*a* stored in the storage section 3, the conveyance controller 2*a* temporarily stores provisional setting data 3*a* of the current state of the ATM 1B as a passing unit 50 installed state in the storage section 3.

The conveyance controller 2*a* then uses the provisional setting data 3*a* that has been temporarily stored in the storage section 3 to perform the "operation prior to start of use" (namely, the operation during checking the operation of each section). That is, in the "operation prior to start of use 3" (namely, the operation during checking the operation of each portion), the conveyance controller 2*a* performs operation control for the passing unit 50 installed state on the first conveyance mechanism 37, the second conveyance mechanism 47 and the passing conveyance mechanism 57.

Accordingly, even if the connector connection detector 2*b* has not detected connection between the sensor-side connector CNa of the left-behind sensor SNR and the device-side connector CNb, or even if the passing unit 50 installation registration has been omitted or has been performed inappropriately, the conveyance controller 2*a* may determine the current state of the ATM 1B as a passing unit 50 installed state if the conveyance duration between the sensors measured by the conveyance duration measurement section 2*e* is equal to or greater than the conveyance duration data 3*d* that has been stored in advance in the storage section 3, and may perform operation control for the passing unit 50 installed state on the first conveyance mechanism 37, the second conveyance mechanism 47 and the passing conveyance mechanism 57.

The notification section 2*g* may notify information that needs to be given also in the case in which the connection of the connector CN of the left behind sensor SNR has been omitted, or in the case in which the passing unit 50 installation registration has been omitted or has been performed inappropriately. Accordingly, the ATM 1B is capable of automatically detecting omitted operations or mistakes and give notifications to an installation operator or a maintenance operator.

As described above, in addition to achieving the effects similar to those of the ATM 1 of the first exemplary embodiment, the ATM 1B of the second exemplary embodiment also enables to verify the precision of travel on the passing conveyance path 56 before use.

Moreover, even if the passing unit 50 installation registration to the setting data, or the connection of the connector CN that has a connection detection function have been omitted, the ATM 1B may automatically recognize the state of the device and may control the device with the optimal parameter pattern for the state of the device.

It is conceivable to provide a detection mechanism for detecting the installation of a passing conveyance mechanism to the opening portion based on the conveyance duration between the sensors in a conventional banknote handling device. However, supposing that such a detection mechanism were to be provided to a conventional banknote handling device, such a detection mechanism may not be able to detect the installation of the passing conveyance mechanism if the travel precision between the sensors is poor. However, the ATM 1B is capable of detecting the installation of the passing conveyance mechanism 57 (here, the passing unit 50) by such a detection mechanism.

The present invention is not limited to the exemplary embodiments described above, and various changes and modifications may be implemented within a range not departing from the spirit of the invention.

For example, similarly to the ATM 1B, the ATM 1, 1A may detect banknote P conveyance errors such as skewing and sticking based on a detection timing of the conveyance sensors SN1, SN2 and the left-behind sensors SNR that are provided on the left and right.

Moreover, for example, the conveyance distance of the banknote P may be converted to a pulse count. Accordingly, the ATM 1, 1A, 1B may be configured to measure a conveyance pulse count of the banknote P rather than the conveyance duration of the banknote P when detecting the thickness T49 of the casing 49 of the second unit 40. In such cases, the ATM 1, 1A, 1B is capable of varying the speed of the banknote P during measurement.

Description has been given of exemplary embodiments in cases in which the banknote handling device 1 is configured as an Automatic Teller Machine (ATM) that circulates the banknotes P. However the present invention is not limited to a banknote circulation type Automatic Teller Machine (ATM), and may also be applied to cash dispensers only for pay-out. The present invention may also be applied to devices such as service window devices used mainly in financial institutions, money changing machines, or cash registers mainly used in the retail industry.

The connector connection detector 2*b* (see FIG. 4) may also be configured to detect not only connection between the sensor-side connector CNa of the Left-behind banknote sensor SNR and the device-side connector CNb, but also connections between the sensor-side connector CNa of various sensors SN other than the left-behind sensor SNR (for example the conveyance sensors SN1, SN2, or the device upper portion sensors SNU or the device lower portion sensors SNL) and the device-side connector CNb. Examples have been given in the exemplary embodiments of a connection operation of the connector CN that has a connection detection function; however, application is also possible wherein connection can be detected by the controller.

The invention claimed is:

1. A banknote handling device that handles banknotes, comprising:

a safe that protects the banknotes;

a first conveyance path provided externally to the safe; and a second conveyance path provided internally to the safe, the safe comprising:

a casing including a plate member that has a first surface facing the first conveyance path and a second surface facing the second conveyance path, the plate member having a thickness that is measured from the first surface to the second surface;

an opening portion provided within the plate member and having a dimension equal to the thickness of the plate member, the opening portion having the banknotes pass therethrough; and a passing unit that is detachably installed within the opening portion, the passing unit being detachably installed within the plate member at the opening portion, the passing unit including a passing conveyance mechanism that passes a banknote along a passing conveyance path between the first conveyance path and the second conveyance path, and a left-behind sensor that detects a banknote that is left behind in the passing conveyance path, the banknote handling device comprising:

a storage section storing casing thickness data expressing the thickness of the plate member of the casing and operation parameter data stipulating detection durations for detection of a conveyance error of banknotes inside the passing unit; and a conveyance controller that is configured to identify one of the detection durations based on the thickness data, and to monitor for occurrence of conveyance errors of the banknotes inside the passing unit during operation of the banknote handling device by using the identified detection duration.

2. The banknote handling device of claim 1, wherein the left-behind sensor includes a sensor-side connector, the banknote handling device further comprising:

a device-side connector that connects to the sensor-side connector;

a connector connection detector that detects connection of the sensor-side connector to the device-side connector;

a first conveyance mechanism that conveys a banknote along the first conveyance path; and a second conveyance mechanism that conveys a banknote along the second conveyance path, the conveyance controller controlling operation of the first conveyance mechanism, the second conveyance mechanism and the passing conveyance mechanism, the conveyance controller determining that a current state of the banknote handling device to be an installed state if the connector connection detector has detected connection of the sensor-side connector to the device-side connector, and the conveyance controller performing operation control, when the current state is the installed state, on each of the first conveyance mechanism, the second conveyance mechanism, and the passing conveyance mechanism.

3. The banknote handling device of claim 2, wherein the storage section, prior to operation commencement, stores the casing thickness data expressing the thickness of the plate member and the operation parameter data stipulating detection durations for detection of a conveyance error of banknotes inside the passing unit, wherein the conveyance controller:

identifies the one of the detection durations if the conveyance controller has determined the current state to be the installed state, prior to the operation commencement.

4. The banknote handling device of claim 2, further comprising:

a conveyance duration measurement section that measures a conveyance duration of a banknote passing through the opening portion of the safe between two predetermined locations; and a conveyance duration comparison section that determines a comparison by comparing the conveyance duration of the banknote measured by the conveyance duration measurement section against a predetermined threshold value duration, wherein if the comparison by the conveyance duration comparison section shows that the conveyance duration of the banknote is equal to or greater than the threshold value duration, even if the connector connection detector has not detected connection of the sensor-side connector to the device-side connector, the conveyance controller determines the current state to be the installed state and performs operation control, based upon the current state being the installed state, on the first conveyance mechanism, the second conveyance mechanism, and the passing conveyance mechanism.

5. The banknote handling device of claim 4, wherein:

the conveyance controller conveys a plurality of banknotes to travel through the opening portion with the first conveyance mechanism and the second conveyance mechanism;

the conveyance duration measurement section measures conveyance durations of the plurality of banknotes that are conveyed by the conveyance controller to travel through the opening portion; and the conveyance duration comparison section compares an average value of the conveyance durations of the plurality of banknotes measured by the conveyance duration measurement section against the threshold value duration.

6. The banknote handling device of claim 2, wherein the conveyance controller performs operation control on the first conveyance mechanism, the second conveyance mechanism, and the passing conveyance mechanism of the passing unit such that a conveyance speed of the banknotes passing through the opening portion of the safe is slower than a conveyance speed at other sections of the first and second conveyance paths that are disposed away from the opening portion.

7. The banknote handling device of claim 2, further comprising a notification section that notifies a maintenance operator of the banknote handling device in a case in which an installation registration of the passing unit to the banknote handling device has been omitted, or in a case in which a connection operation of the sensor-side connector to the device-side connector has been omitted.

8. The banknote handling device of claim 1, further comprising a drive mechanism provided at a periphery of the opening portion of the safe, the drive mechanism engaging with the passing conveyance mechanism of the passing unit to supply drive force to the passing conveyance mechanism.

9. A passing unit that is installed within an opening portion of a banknote handling device, the opening portion being provided at a casing of a safe inside the banknote handling device, the banknote handling device including a first conveyance path that is a conveyance path provided externally to the safe, the banknote handling device further including a second conveyance path that is a conveyance path provided internally to the safe, the casing including a plate member that has a first surface facing the first conveyance path and a second surface facing the second conveyance path, the plate member having a thickness that is measured from the first surface to the second surface, the opening portion being within the plate member and having a dimension equal to the thickness of the plate member, the passing unit comprising:

a passing conveyance path that passes a banknote between the first conveyance path and the second conveyance path;

a passing conveyance mechanism that conveys the banknote along the passing conveyance path;

a left-behind sensor that detects a banknote left behind in the passing conveyance path; and an other casing that internally accommodates the passing conveyance path, the passing conveyance mechanism and the left-behind sensor, the other casing being formed with dimensions so as to be detachable with respect to the opening portion of the banknote handling device, the passing unit being installed within the plate member in the opening portion, wherein the banknote handling device comprises:

a storage section storing casing thickness data expressing the thickness of the plate member of the casing and operation parameter data stipulating detection durations for detection of a conveyance error of banknotes inside the passing unit; and a conveyance controller that is configured to identify one of the detection durations based on the thickness data, and to monitor for occurrence of conveyance errors of the banknotes inside the passing unit during operation of the banknote handling device by using the identified detection duration.

10. The passing unit of claim 9, wherein the passing conveyance mechanism engages with a drive mechanism provided in the banknote handling device to obtain drive force and convey a banknote.

11. The banknote handling device of claim 1, wherein the left-behind sensor is disposed in the passing conveyance path.

12. The passing unit of claim 9, wherein the left-behind sensor is disposed in the passing conveyance path.

13. The banknote handling device of claim 1, wherein the passing unit further comprises a positioning portion that fixes the passing unit in the opening portion.

14. The banknote handling device of claim 1, wherein the passing unit comprises a plurality of left behind sensors that are arranged in a direction substantially orthogonal to a conveyance direction of a banknote in the passing unit.

15. The banknote handling device of claim 1, wherein the passing conveyance mechanism is disposed completely within the plate member.

16. The passing unit of claim 9, wherein the passing conveyance mechanism is disposed completely within the plate member.

17. The banknote handling device of claim 1, further comprising a banknote unit that is disposed on an upper face of the safe and that includes the first conveyance path, and the passing conveyance path connects between the banknote unit and the safe to pass banknotes therebetween.

18. The banknote handling device of claim 1, wherein the thickness is measured along a completely straight line that is perpendicular to at least one of the first surface or the second surface, the opening portion extends from the first surface to the second surface, and the passing unit is disposed completely within the opening portion.

19. A banknote handling device that handles banknotes, comprising:

a safe that protects the banknotes;

a first conveyance path provided externally to the safe; and a second conveyance path provided internally to the safe, the safe comprising:

a casing including a plate member that has a first surface facing the first conveyance path and a second surface facing the second conveyance path, the plate member having a thickness that is measured from the first surface to the second surface;

an opening portion provided within the plate member and having a dimension equal to the thickness of the plate member, the opening portion having the banknotes pass therethrough; and a passing unit that is detachably installed within the opening portion, the passing unit being detachably installed within the plate member at the opening portion, the passing unit including a passing conveyance mechanism that passes a banknote along a passing conveyance path between the first conveyance path and the second conveyance path, and a left-behind sensor that detects a banknote that is left behind in the passing conveyance path, the banknote handling device including a storage section storing a predetermined threshold value duration, a conveyance duration measurement section that is configured to measure a conveyance duration of a banknote passing through the opening portion of the safe between two predetermined locations in a periphery of the passing unit, and a conveyance controller configured to be responsive to the conveyance duration being equal to or above the predetermined threshold value duration to determine a current state of the banknote handling device to be a passing unit installed state to perform operation control on the banknote handling device based upon the passing unit installed state.

* * * * *